US005305068A

United States Patent [19]

Sato et al.

[11] Patent Number: 5,305,068

[45] Date of Patent: Apr. 19, 1994

[54] CONTINUOUS PAPER FEED PREVENTION LOCK MECHANISM FOR PRINTER

[75] Inventors: Tsutomu Sato; Masatoshi Takano, both of Tokyo; Taizo Saito, Okayama; Hiroyuki Yamaguchi, Tokyo, all of Japan

[73] Assignee: Asahi Kogaku Kabushiki Kaisha, Tokyo, Japan

[21] Appl. No.: 872,834

[22] Filed: Apr. 23, 1992

[30] Foreign Application Priority Data

| | | | |
|---|---|---|---|
| Apr. 23, 1991 | [JP] | Japan | 3-185946 |
| Oct. 31, 1991 | [JP] | Japan | 3-097914 |
| Nov. 6, 1991 | [JP] | Japan | 3-319862 |
| Nov. 22, 1991 | [JP] | Japan | 3-104087 |
| Apr. 15, 1992 | [JP] | Japan | 4-141255 |

[51] Int. Cl.[5] ..... G03G 21/00; G03G 15/00

[52] U.S. Cl. ..... 355/309; 226/59; 226/74; 355/308

[58] Field of Search ..... 355/308, 309, 316, 317; 271/264, 266; 400/616, 616.1, 616.2; 226/24, 33, 43, 59, 74, 75, 79

[56] References Cited

U.S. PATENT DOCUMENTS

| | | | |
|---|---|---|---|
| 3,893,389 | 7/1975 | Kodis . | |
| 4,087,172 | 5/1978 | Van Dongen | 226/79 |
| 4,234,261 | 11/1980 | Hendrischuk et al. . | |
| 4,646,162 | 2/1987 | Sue . | |
| 4,697,941 | 10/1987 | Takenoya et al. . | |
| 4,987,448 | 1/1991 | Chikama | 355/316 X |
| 5,019,872 | 5/1991 | Zajac, Jr. | 355/317 |
| 5,026,328 | 6/1991 | Unuma | 226/74 X |
| 5,037,222 | 8/1991 | Quick et al. | 400/616.2 X |
| 5,061,967 | 10/1991 | Isobe | 355/310 |
| 5,063,416 | 11/1991 | Honda et al. | 365/316 |

FOREIGN PATENT DOCUMENTS

| | | |
|---|---|---|
| 0213598 | 3/1987 | European Pat. Off. . |
| 2225751 | 6/1990 | United Kingdom . |

*Primary Examiner*—A. T. Grimley
*Assistant Examiner*—Sandra L. Brasé
*Attorney, Agent, or Firm*—Sandler, Greenblum and Bernstein

[57] ABSTRACT

A printer, for printing on continuous recording paper, includes tractors disposed in the recording paper feed path of the printer, with each of the tractors circumferentially travelling in synchronism with movement of the continuous recording paper when the tractors engage feed holes of the continuous paper. When no printing operation is performed, travel of the tractors can be prevented by operation of an electromagnetic clutch, or a combination of one way clutches. Further, the printer uses an electrophotographic method wherein when no printing operation is performed, a transfer charger or fixing roller can be retracted from an operational position. A lever, associated with movement of the transfer charge or fixing roller, is pressed against and locked with the pulley fixed to the rotating shaft of each of the tractors to thereby prohibit the movement of the tractor. Further, a swingable arm can be provided having an engaging projection capable of being locked with the feed holes of the continuous recording paper. The swingable arm is swung in association with the movement of the transfer charger or fixing roller, which can be retracted from the operational position when no printing operation is performed. Thus, the engaging projection is engaged with the feed hole of the continuous recording paper to thereby regulate the movement of the continuous recording paper.

93 Claims, 19 Drawing Sheets

CONTINUOUS PAPER FEED PREVENTION LOCK MECHANISM FOR PRINTER

BACKGROUND OF THE INVENTION

The present invention relates to a printer for forming an image on a continuous paper.

Conventionally, know are copy machines, laser beam printers and the like which perform printing is by an electrophotographic method, wherein a uniformly charged photoconductive material on the surface of a photoconductive drum is exposed to form a latent image by partially removing charges therefrom. Charged toner is then adhered to the latent image and developed (forming a toner image), and the developed toner image is transferred to a recording paper and fixed thereon by a fixing unit.

Some printers making use of the electrophotographic method print images on a continuous folded paper referred to as fanfold paper (hereinafter, simply abbreviated as a continuous paper), which Is provided with feed holes along the side edges thereof, fed in an alternatively folded state for each page, and is further provided with a perforated tear line defined along each folded line thereof so that the paper can be easily cut off.

The printer making use of the electrophotographic method generally employs a heat roll fixing unit as a fixing unit by which toner is fixed onto a recording paper. The heat roll fixing unit includes a pair of fixing rollers pressed against each other, one of the which is a heat roller which can be heated. Thus, when a recording paper on which unfixed toner is placed is positioned between the pair of the fixing rollers and heated by the heat roller, the toner is heated and melted. When, however, this type of heat roll fixing unit is used in a printer which prints on continuous paper, a disadvantage may arise in that the recording paper, (continuous paper) waiting for a printing operation, held between the heat roller and the press roller, is burnt or makes a blister at the same position thereof due to tile heat supplied from the heat roller. In particular this disadvantage is liable to arise when the heat control system (a temperature sensor, control unit) for the heat roller is out of order. Therefore, it is contemplated that one of the pair of the fixing rollers (preferably the heat roller) be arranged to be retracted so that the roller can be retracted when the continuous paper waits for printing.

Further, when the printer employs a rotating photoconductive drum, a toner image is transferred when the exposed position of the photoconductive drum is rotated to a position confronting a recording paper (that is, the exposed position of the photoconductive drum is different from the position at which the toner image is transferred from the photoconductive drum to the continuous recording paper in the peripheral direction of the photoconductive drum), and thus the photoconductive drum must be moved with respect to the continuous paper (to select a desired portion of the continuous paper) prior to a printing operation in order to start a print at a position of the continuous paper spaced apart from the perforated tear line thereof (i.e., the front edge of a page) by a predetermined distance. When the continuous paper is in an image transfer state (the continuous paper is abutted against the surface of the photoconductive drum) while the image transfer is performed, a problem arises in that photoconductive material on the surface of the photoconductive drum is scratched or worn by the continuous paper. Further toner remaining on the surface of the photoconductive drum is adhered to the continuous paper and causes extraneous matter to appear on the paper (i.e., makes the paper appear "dirty"). To cope with this problem, it is contemplated that a transfer charger be arranged to be retracted from a transfer position so that it is retracted while the continuous paper waits for a printing.

Nevertheless, with the above arrangement in which the transfer charger and fixing roller can be retracted from the transfer position and fixing position, respectively, there is no ability to keep the continuous paper in an unmovable state. Rather the portion of the continuous paper which is intended to be stopped at a predetermined position while waiting for the resumption of a printing operation, is moved by a force applied to the continuous paper to cut off a printed and discharged page thereof along a perforated tear line. Thus when the printing operation is resumed, a printing is started from an offset position of the continuous paper.

SUMMARY OF THE INVENTION

An object of the present invention is to provide a paper feed lock mechanism for a printer by which a continuous paper is prevented from being moved while waiting for a printing, so that the printing is resumed from the proper position of the continuous paper.

To achieve the above object, according to the present invention, a recording paper movement regulation means is provided for regulating the movement of the continuous paper while waiting for printing.

With this arrangement, the continuous paper is prevented from being moved while waiting for a printing operation, and the printing operation can be resumed from a proper position of the continuous paper.

DESCRIPTION OF THE ACCOMPANYING DRAWINGS

DESCRIPTION OF THE EMBODIMENTS

Next, embodiments of the present invention will be described with reference to the drawings.

Figure 1:
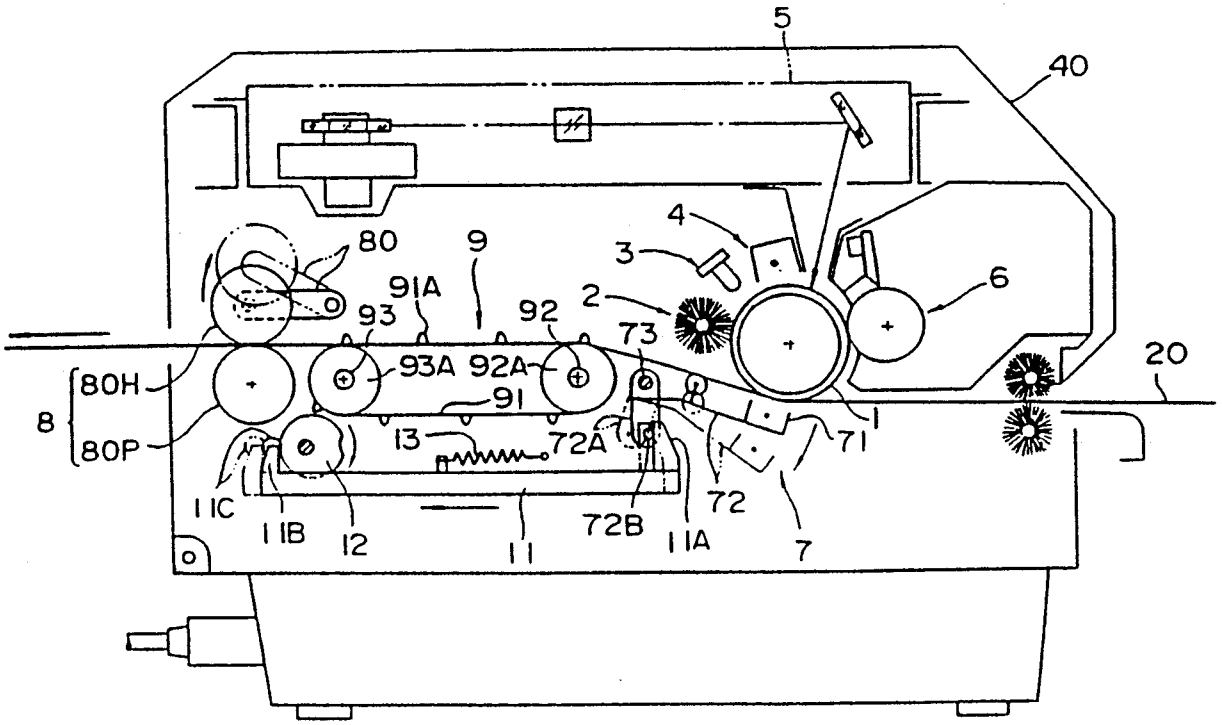
FIG. 1 is a schematic arrangement diagram of a laser beam printer to which a paper feed lock mechanism for a printer according to the present invention is applied.

FIG. 1 is a schematic arrangement diagram of a laser beam printing apparatus as a whole to which an embodiment of a paper feed lock mechanism for a printer according to the present invention is applied. This laser beam printing device, used as an output device for a computer and the like, scans a photoconductive material on the surface of a rotating photoconductive drum 1, by a laser beam modified based on input characters or image information and prints the same as an output on a fanfold paper 20 as a continuous paper by making use of an electrophotographic method. Toner cleaner 2, discharging unit 3, charging unit 4, scanning optical system 5 by which a laser beam is introduced onto the photoconductive drum 1, developing unit 6 and transfer unit 7 are disposed, respectively, in a predetermined order around the periphery of the photoconductive drum 1 along the rotating direction thereof shown by the arrow in the Figure. The transfer unit 7 is positioned below the photoconductive drum 1, a fixing unit 8 is disposed at a position to which the fanfold paper 20 is fed (the left side in the Figure), and a tractor 9 is disposed in a feed path along which the fanfold paper 20 is fed from the photoconductive drum 1 to the fixing unit 8.

The surface of the photoconductive drum I is main scanned (exposed) by a laser beam from the scanning optical system 5 in the rotating axis direction of the photoconductive drum 1 and the photoconductive drum 1 is rotated (auxiliary scanned). A latent image formed on the surface of the photoconductive drum 1, is developed to a toner image by the developing unit 6. The toner image is not transferred by the transfer unit 7 onto the fanfold paper 20, which is fed from the front side to the rear side (from the right side to the left side in the Figure) below the photoconductive drum 1. The toner image, after having been transferred onto the fanfold paper 20, is then fixed by the fixing unit 8 and then output.

The transfer unit 7 is arranged such that a corona charger 71 as a transfer device is held by an arm 72 swingingly supported by a chassis (not shown) of the laser beam printing device through a shaft 73 and the swinging operation of the arm 72 causes the corona charger 71 to be positioned at a transfer position spaced apart from the surface of the photoconductive drum 1 by a predetermined distance and at a retracted portion shown by an imaginary line in FIG. 1 which is more distant from the photoconductive drum 1 than the transfer position.

The arm 72 is arranged such that the corona charger 71, held by a spring (not shown) is urged to the side of the transfer position shown by the solid line in FIG. 1. When pin 72B, horizontally attached to the side of an operation arm 72A which is, in turn, projected downward of the arm 72, is actuated by an operation unit 11A standing at the end of an operation bar 11, slidingly moved by a cam 12, the corona charger 71 is swung clockwise as shown by the imaginary line in FIG. 1, and thus moved to the retracted position.

The operation bar 11 is arranged along the chassis of the printer in such a manner that it can slide along the front and rear directions of the chassis (in the direction parallel to the direction along which the fanfold paper 20 is fed). The operation unit 11A is located at an end of the operation bar 11 on the side from which the fanfold paper 20 is introduced. Cam follower 11C is attached to a standing portion 11B at the other end of operation bar 11, abutted against the outside peripheral cam surface of the cam 12 by an urging force which is applied by a spring 13. Spring 13 is stretched between the operation bar 11 and the chassis and slidingly moved in accordance with the dislocation of the outside peripheral cam surface of the cam 12 as it is rotated.

Cam 12 is rotated by a motor which is controlled by a control unit (not shown) of the laser beam printing device, and moves the corona charger 71 to the transfer position when a printing operation is performed. Likewise, cam 12 is rotated to move corona charger 71 to the retracted position while the printing operation is on hold.

The fixing unit 8 is a so-called heat roll fixing unit composed of a press roller 80P formed of silicone rubber or the like, rotatably supported by the chassis, the surface of which has a predetermined hardness. Heat roller 80H is disposed on the press roller 80P and pressed thereagainst. Heat roller 80H is heated to a predetermined temperature by a halogen lamp inserted thereinto.

Heat roller 80H is supported by a holder 80, which is swingingly supported by the chassis of the laser beam printing device. When the holder 80 is swung, the heat roller 80H can be retracted from the fixing position at which the heat roller 80H is pressed against the press roller 80P by a predetermined pressure, to an upward position, as shown by the imaginary line in FIG. 1. A gear (not shown) fixed to an end of the heat roller 80H is coupled to a drive motor (not shown) controlled by the control unit (not shown) of the laser beam printing device through a gear train and rotated by the drive motor. When the heat roller 80H is at the fixing position at which it is pressed against the press roller 80P, the heat roller 80H causes the fanfold paper 20, which has an unfixed toner image placed thereon and passes through both rollers 80P and 80H, to be pressed and heated so that the toner is melted and fixed on the fanfold paper 20 (fixing operation). At the same time fixing unit 8 feeds the fanfold paper 20. In the arrangement of this embodiment, the fanfold paper 20 is fed only by the fixing unit 8.

The swing operation of the holder 80 (the retraction of the heat roller 80H) is performed by a drive means not shown in FIG. 1. This drive means is controlled by a control unit (not shown) in the same way as the corona charger 71 of the aforesaid transfer unit 7, to cause the heat roller 80H to be retracted while a printing operation is on hold.

Tractor 9 is composed of tractor belts 91, which are each stretched between pulleys 92A and 93A, which are disposed on the front and rear sides from and to which the fanfold paper 20 is fed. Tractor belts 91 are spaced apart from each other by a predetermined distance. Each tractor belt 91 has projections 91A formed on the outside periphery thereof at the same intervals as those of the feed holes which are defined along the side edges of the fanfold paper 20. Thus the positions of the projections 91A coincide with the positions of the feed holes of the fanfold paper 20, so that to be fed so projections 91A engage with the feed holes. Since the projections 91A are engaged with the feed holes, the tractor belt 9 is rotated, following the movement of the fanfold paper 20 fed by the fixing unit 8, such that the feed path of the fanfold paper 20 is regulated to prevent skew.

Alternatively, tractor 9 can be driven so that it feeds fanfold paper 20 until the extreme end thereof reaches the fixing unit 8 when it is newly set to the laser beam printing device.

A first embodiment of a recording paper movement regulation means according to the present invention provided with the tractor 9 will be described.

Figure 2:
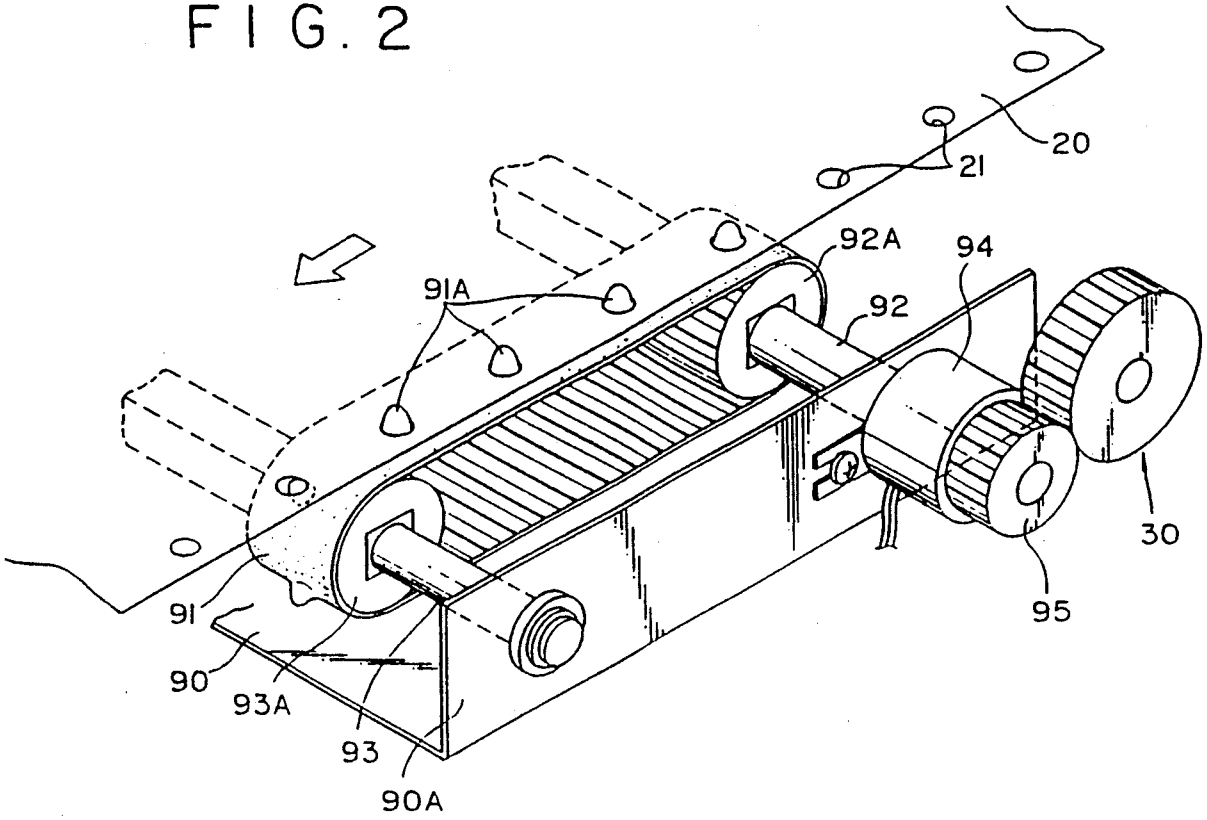
FIG. 2 is an enlarged perspective view showing the arrangement of a tractor portion to which a first embodiment of the present invention is applied.

As shown in FIG. 2 illustrating the schematic arrangement of the tractor belt 91 in a perspective view, it is stretched between the pulleys 92A, 93A of the same diameter mounted on two shafts (first and second shafts 92, 93), disposed on the front and rear sides from and to which fanfold paper 20 is fed. Tractor belts 91 are spaced apart from each other by a predetermined distance. The pulleys 92A, 93A cannot be relatively rotated and can be slidingly moved in an axial direction. The circumferential travel path on the upper side of the tractor belts 91 coincides with the feed path of the fanfold paper 20. Pulleys 92A, 93A are slidingly moved in the right and left directions (in the width direction of the fanfold paper 20), i.e., in the axial direction of the first and second shafts 92, 93 so that the projections 91A can be located at the positions corresponding to the feed holes 21 defined along the side edges of the fanfold paper 20, since different rolls of continuous paper may have varying widths.

Note, although FIG. 2 shows only one of the tractor belts 91 which corresponds to the feed holes 21 along the one side edge of the fanfold paper 20, tractor belt 91 is also disposed at the position corresponding to the feed holes defined along the other side edge of the fanfold paper 20 in the same way. Further, the tractor belt 91 is a so-called toothed belt with gear-shaped teeth formed on the inside periphery thereof at predetermined intervals, and the pulleys 92A, 93A are a toothed pulleys with teeth formed on the outside periphery thereof, which interfit with the teeth of the inner peripheries of tractor belts 91. Thus, no slip is occurs between tractor belt 91 and the pulleys 92A, 93A).

First and second shafts 92, 93 are rotatably supported, respectively, by the vertically standing portion 90A along a side edge of a tractor chassis 90 serving as a chassis for the tractor 90 and fixed to the chassis (not shown) of the laser beam printing device. The first shaft 92 on the rear side (upstream side) from which the fanfold paper 20 is fed has the end on the side shown in the Figure which projects outwardly of the standing portion 90A of the chassis and a drive gear 95 as a driving force transmission means is mounted on the projected end through an electromagnetic clutch 94 as the recording paper movement regulation means in this first embodiment.

The drive gear 95 is coupled with a drive motor (not shown) as a drive source through a gear train 30 and rotated thereby.

The electromagnetic clutch 94 is engaged or disengaged by an electromagnetic actuator so that a rotating force is transmitted or not transmitted. When the electromagnetic clutch 94 is engaged, the drive gear 95 cannot be relatively rotated with respect to the first shaft 92 and thus the rotation of the drive gear 95 is transmitted to the first shaft 92, while when the electromagnetic clutch 94 is disengaged (when the clutch is disconnected), the drive gear 95 can be relatively rotated with respect to the first shaft 92. The electromagnetic clutch 94 is connected and disconnected by a control unit (not shown) of the laser beam printing device.

With the above arrangement, when a printing operation is put on hold the drive motor is stopped and the electromagnetic clutch 94 is engaged by the control unit to thereby cause the first shaft 92 to be coupled with the drive motor through the electromagnetic clutch 94 and gear train 30, and thus the drive motor, when stationary, acts as a rotational load on the first shaft 92 (i.e., acts as a circumferentially rotating load on the tractor belts 91). As a result, the movement of the fanfold paper 20 via the feed holes 21 along the side edges of which are engaged with the projections 91A, the tractor belts, is regulated by the tractor belts 91 acting with the load imposed thereon. Thus the movement of the fanfold paper 20, which would otherwise have been caused by a force applied thereto when a portion of the fanfold paper 20 having been printed is cut off along the perforated tear line thereof, Is prevented.

When the fanfold paper 20 is newly set to the laser beam printing device, the drive motor is rotated and tile electromagnetic clutch 94 is engaged.

The tractor belts 91 are thus caused to travel by the drive motor and controlled so that the fanfold paper 20 is fed until the extreme edge thereof reaches an initially set position. Further, when a printing operation is carried out, the electromagnetic clutch 94 is disengaged, and thus the tractor belts 91 are caused to travel following to the fanfold paper 20 fed by the fixing unit 8, independently of the drive motor.

Needless to say, the electromagnetic clutch 94 may be engaged or disengaged in any one of the ON and OFF states thereof.

Next, another embodiment (second embodiment) of the present invention will be described wherein the movement of the fanfold paper 20 is prevented by regulating the operation of the tractor 9.

The second embodiment is arranged to regulate the rotational movement of the tractor belts 91 of a tractor 9 by making use a one way clutch which is engaged when rotated in one direction to transmit a rotational force and disengaged when rotated in an opposite direction to permit a relative rotation. In the second embodiment, the same numerals as used in the first embodiment are used to designate the same parts or portions and the description thereof is omitted.

Figure 3:
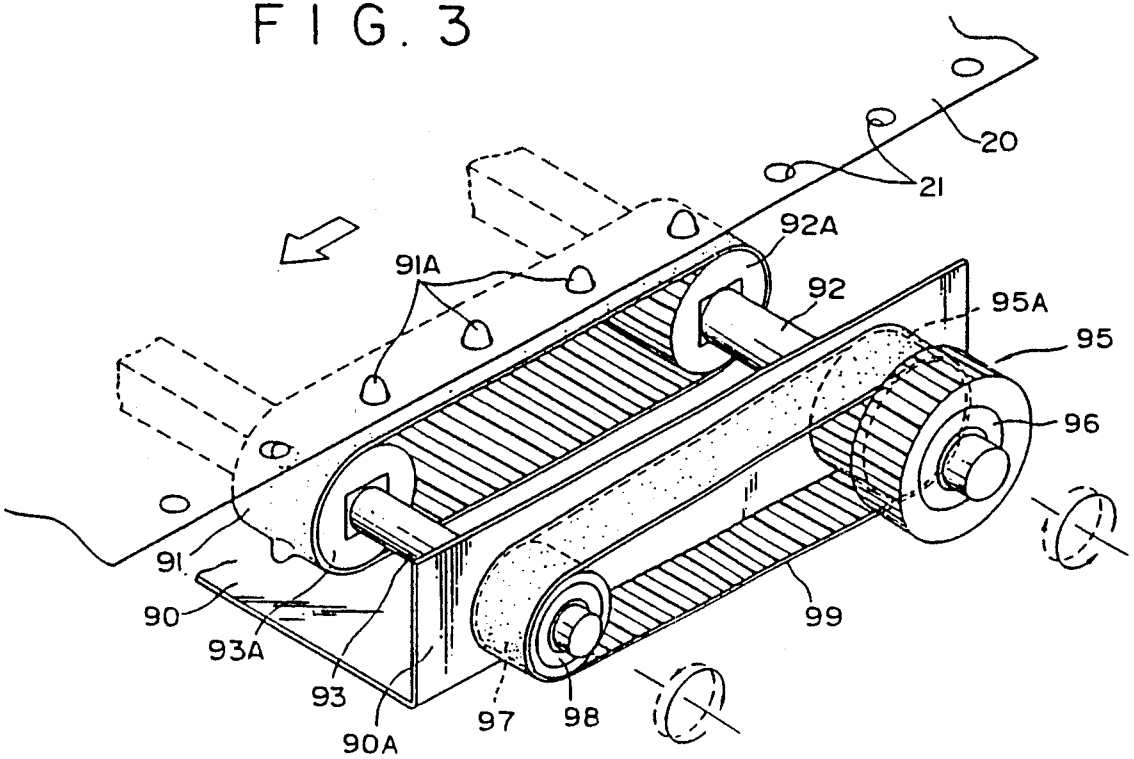
FIG. 3 is an enlarged perspective view illustrating the arrangement of a tractor portion showing a second embodiment of the present invention.

As shown in FIG. 3 illustrating the schematic arrangement of the tractor belt 91 in a perspective view, it is stretched between pulleys 92A, 93A of the same diameter mounted on two shafts (first and second shafts 92, 93) disposed on the front and rear sides from and to which the fanfold paper 20 is fed and are spaced apart from each other by a predetermined distance, in the same way as the aforesaid embodiment. The pulleys 92A, 93A cannot be relatively rotated, but can be slidingly moved in an axial direction.

The first and second shafts 92, 93 are rotatably supported, respectively, by the vertically standing portion 90A along a side edge of a tractor chassis 90 and the ends thereof on the side shown in the Figure project outwardly of the standing portion 90A of the chassis, and a drive gear 95 as a drive force transmission member is attached, through the one way clutch 96 as a one way engagement means, to the projected end of the first shaft 92 located on the rear side (upstream side) from which the fanfold paper 20 is fed. Supposing that the first shaft 92 is stationary, when the drive gear 95 is rotated in the direction shown by the solid arrow in the Figure (in the direction along which the fanfold paper 20 is fed), the one way clutch 96 is engaged to cause the first shaft 92 to be driven following to the movement of the fanfold paper 20. When the drive gear 95 is driven in an opposite direction shown by the dot arrow in the Figure, the one way clutch 96 is disengaged to cause the drive gear 95 to be loosely rotated with respect to the first shaft 92.

The drive gear 95 is coupled with a drive motor (not shown) as through a gear train and is rotated thereby. The rotation of the drive gear 95 causes the first shaft 92 to be rotated through the one way clutch 96, and thus the tractor belts 91 are caused to travel with the circumferential travel path on the upper side thereof, moving in the direction along which the fanfold paper 20 is fed (the one way clutch 96 is engaged and can be rotated in the direction in which the first shaft 92 is rotated by the rotation of the drive gear 95).

The tractor belt 91 has a circumferential travel speed set a little slower than the feed speed of the fanfold paper 20 fed by the fixing unit 8, and thus the feed speed of the fanfold paper 20 is faster than the circumferential travel speed of the tractor belt 91 in a usual printing operation in which the fanfold paper 20 is fed by the fixing unit 8. This difference of speed, however, is absorbed by the disengagement of the one way clutch 96. More specifically, when the speed of the fanfold paper 20 fed by the fixing unit 8 is faster than the circumferential travel speed of the tractor belt 91 driven by the rotational force from the drive motor, the tractor belt 91 is caused to circumferentially travel by the fanfold paper 20 in the direction along which the fanfold paper 20 is fed and thus the first shaft 92 is rotated faster than the drive gear 95. Since, however, this means that the drive gear 95 is relatively rotated with respect to the first shaft 92 in the direction opposite to the feed direction of the fanfold paper 20, the rotation of the first shaft 92 is permitted and the feed of the fanfold paper 20 effected by the fixing unit 8 is not prevented. Note, in this embodiment, the drive motor for driving a tractor 9 (for causing the tractor belts 91 to travel) also rotates the heat roller 80H of the fixing unit 8 and the drive gear 95 is coupled with the drive motor through the gear train at all times. Thus, drive gear 95 is rotated at all times, although it does not contribute to the feed of the fanfold paper 20 when a printing operation is carried out, and the fanfold paper 20 is fed by the fixing unit 8.

The drive gear 95 is integrally formed with a first toothed pulley 95A as a first driving force transmission means for a toothed belt 99, which is disposed on the side of the standing portion 90A of the chassis, a second toothed pulley 97, as a second driving force transmission means for the toothed belt 99 is mounted, through one way clutch 98 as a one way engagement means, on the end of the second shaft 93, projecting outwardly of the standing portion 90A of the chassis at the position thereof corresponding to the above first pulley 95A. Second shaft 93 is disposed on the front side to which the fanfold paper 20 is fed, and the toothed belt 99 is stretched between the toothed pulleys 95A, 97 to thereby arrange a recording paper movement regulation means.

One way clutch 98 is disengaged in the rotational direction shown by the dot arrow in FIG. 3 in which the rotation of the drive gear 95 (i.e., the first toothed pulley 95A) by which the fanfold paper 20 is fed is transmitted through the toothed belt 99 to thereby cause the second toothed pulley 97 to be loosely rotated with respect to the second shaft 93, while the one way clutch 98 is engaged in the opposite rotational direction shown by the solid arrow in the FIG. 3 so that the second shaft 93 is rotated following the rotation of the second toothed pulley 97.

Further, the second toothed pulley 97 has a diameter smaller than that of the first toothed pulley 95A (i.e., the former has a less number of teeth than the latter). In addition, when the tractor belts 91 are caused to circumferentially travel by the fanfold paper 20, fed by the fixing unit 8, the rotation of the second toothed pulley 97 to which the rotation of the drive gear 95, driven by the drive motor, is transmitted through the first toothed pulley 95A, and toothed belt 99, is set faster than the rotation of the second shaft 93 caused by the circumferential travel of the tractor belts 91. As a result, with respect to the first toothed pulley 95A and second toothed pulley 97 rotated in synchronism through the toothed belt 99, the pulley 97 is rotated faster than the pulley 95A. Further the rotational speed of the pulley 97 is faster than the rotational speed of the second shaft 93 when the tractor belts 91 are caused to circumferentially travel by the fanfold paper 20 fed by the fixing unit 8, and at this time the one way clutch 98 is actuated to thereby loosely rotate the second toothed pulley 97 with respect to the second shaft 93.

With the above arrangement, when a force is applied for moving the fanfold paper 20 toward the discharge side thereof in order to cut off a printed portion of the fanfold paper 20 along a perforated tear line thereof, in a printing operation wait state in which the corona charger 71 of a transfer unit 7 and the heat roller 80H of the fixing unit 8 are retracted from a transfer position or fixing position, respectively, the following operation is carried out to prevent the movement of the fanfold paper 20.

More specifically, when a force for moving the fanfold paper 20 to the discharge side thereof is applied thereto, a force Is applied to the tractor belts 91 the projections 91A, of which are engaged with the feed holes 21 of the fanfold paper 20. The tractor belts 91 are caused to circumferentially travel in the direction along which the fanfold paper 20 is fed. At this time, although the drive gear 95 is not driven is stationary because the printing operation is on hold, the first shaft 92 on which the drive gear 95 is mounted can be rotated because the one way clutch 96 functions on the disengagement side. The second toothed pulley 97 mounted on the other second shaft 93 is rotated together with the second shaft 93 because the one way clutch 98 interposed therebetween functions on the engaging side. Since, however, the second toothed pulley 97 is associated with the first toothed pulley 95A through the toothed belt 99, the first toothed pulley 95A must be rotated in the same direction as that of the first shaft 92 to permit the second toothed pulley 97 to be rotated. As described above, however, the number of the teeth of the second toothed pulley 97 is less than that of the first toothed pulley 95A and thus the rotational speed of the first toothed pulley 95A rotated by the rotation of the second toothed pulley 97 through the toothed belt 99 is slower than the rotational speed of the second pulley 97. More specifically, the second toothed pulley 97 is rotated at the same speed as that of the second shaft 93 and the first toothed pulley 95A is rotated at a speed slower than the above speed.

On the other hand, since the pulleys 92A, 93A mounted on the first and second shafts 92, 93 associated through the tractor belts 91 have the same diameter, both shafts 92, 93 must be rotated at the same speed and as a result a difference of speed is caused between the first shaft 92 and the first toothed pulley 95A (although the first shaft 92 and first toothed pulley 95A are rotated in the same direction, the rotational speed of the latter is slower than that of the former). This rotational state means that the first toothed pulley 95A is relatively rotated in a reverse direction with respect to the first shaft 92 and thus the one way clutch 96 is functioned to a disengagement side, so that the rotation of the first toothed pulley 95A does not interfere with the rotation of the first shaft 92 and vice versa. Since, however, the drive gear 95 with which the first toothed pulley 95A is integrally formed is coupled with the drive source (drive motor) through the gear train, the first toothed pulley 95A cannot be rotated unless the gear train and drive motor are rotated and thus the first toothed pulley 95A cannot be rotated due to the resistance on the side of the drive source. Therefore, the second toothed pulley 96, second shaft 93, pulley 93A mounted on the second shaft 93 are not rotated and as a result the tractor belts 91 cannot be caused to circumferentially travel by being locked, so that the movement of the fanfold paper 20 is prevented.

Although the diameters (the numbers of the teeth) of the first and second toothed pulleys 95A, 97 are set such that the first toothed pulley 95A is rotated slower than the second toothed pulley 97 by the rotational force input thereto from the tractor belts 91 in the above embodiment, this is because of that the pulleys 92A, 93A mounted on the first and second shafts 92, 93 associated by the tractor belts 91 have the same diameter. When, however, the pulleys 92A, 93A have a different diameter and the first and second shafts 92, 93 are rotated differently (i.e, the first shaft 92 is rotated slower than the second shaft 93), the first toothed pulley 95A may have the same diameter (the same number of teeth) as that of the second toothed pulley 97.

Further, although the first shaft 92 Is associated with the second shaft 93 through the toothed belt 99 in the above embodiment, they may be of course associated through a gear train. Furthermore, although the one way clutch 97 as an one way engagement means is interposed between the second shaft 93 and the second toothed pulley 97 to permit the second toothed pulley 97 to be rotated at a high speed when an image is formed, one way clutch may be interposed between the second shaft 93 and the pulley 93A associated therewith through the tractor belts 91 as the one way engagement means. In this case, when a rotational force is applied to the pulley 93A in the state that the second shaft 93 is stationary, the one way clutch is engaged and the shaft 93 is rotated following the rotation of the pulley 93A, and when the pulley 93A is rotated in a direction opposite to the above, the one way clutch is disengaged.

Next, a third embodiment of the present invention will be described with reference to FIGS. 4 and 5, wherein the same numerals as used in the above embodiment are used to designate the same parts or portions and the description thereof is omitted.

In this embodiment, a brake lever 15 as a stopper member associated, through a swing lever 14, with the sliding movement of an actuation lever 11, for retracting the corona charger 71 of a transfer unit 7, unrotatably fixes a friction pulley 92B mounted on one of the shafts (a first shaft 92) of a tractor 9, and thus tractor belts 91 are prevented from circumferentially traveling. Note, FIG. 4 shows a state in which a printing operation is performed and FIG. 5 shows a state in which a printing operation is on hold. Further, although the fanfold paper is not shown in FIGS. 4 and 5, it is fed in the direction shown by the arrow. The tractor belts 91 are spaced apart from each ether by a predetermined distance, disposed in the direction along which the fanfold paper 20 is fed, and stretched between pulleys 92A, 93. Pulleys 92A, 93A have the same diameter and cause tractor belts 91 to circumferentially travel. These pulleys 92A, 93A are mounted on two shafts (the first shaft 92 and a second shaft 93) which are rotatably supported, respectively, by the vertically standing portion 90A along a side edge of a tractor chassis 90 in such a manner that they cannot be relatively rotated and can be slidingly moved in an axial direction.

Figure 4:
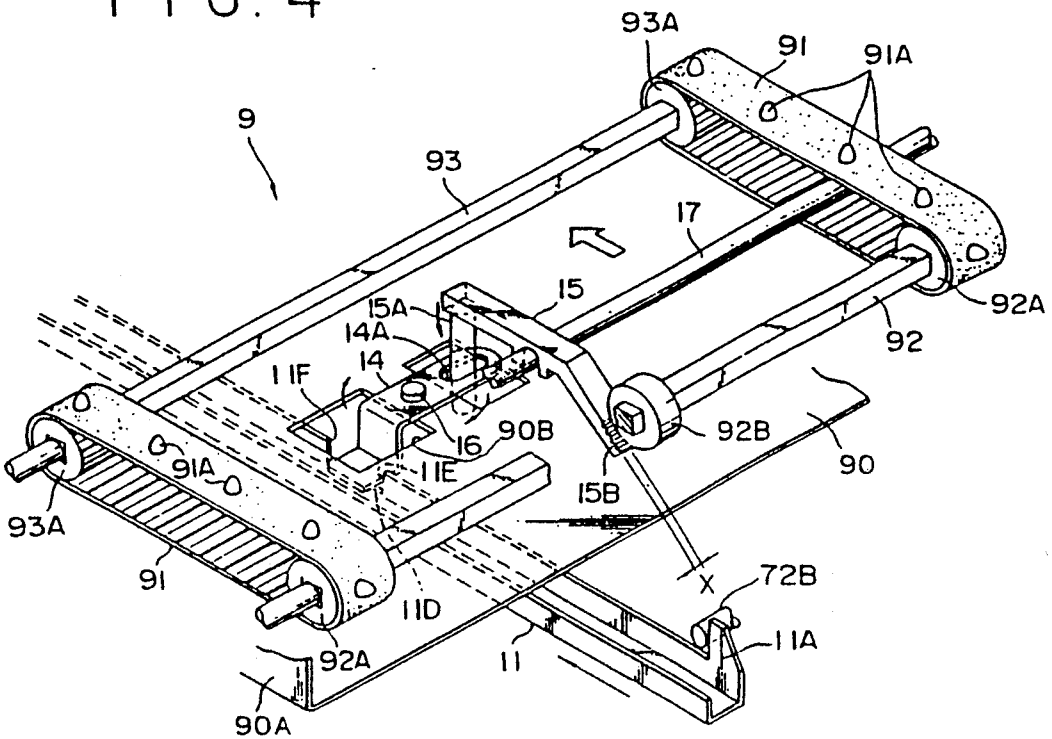
FIG. 4 is a perspective schematic view of a tractor portion showing a third embodiment of the present invention.
Figure 5:
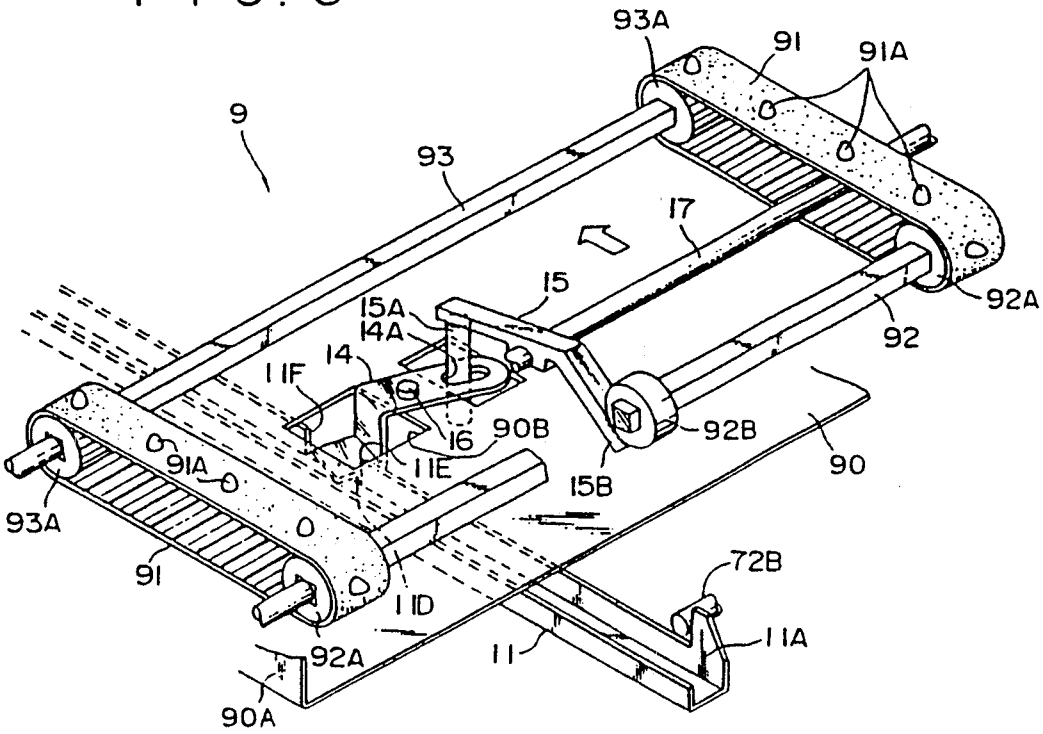
FIG. 5 is a diagram showing an operating state started from FIG. 4.

Further, although not shown in FIGS. 4 and 5, a drive gear associated with a drive motor through a gear train is mounted on the first shaft 92, or second shaft 93, through a one way clutch in the same way as the aforesaid second embodiment. The drive motor causes the tractor belts 91 to circumferentially travel in the direction along which the fanfold paper 20 is fed, and when the fanfold paper 20 is pulled in the feed direction thereof, the tractor belts 91 can be loosely rotated by the operation of the one way clutch. The drive motor causes the tractor belts 91 to circumferentially travel at a speed a little slower than that of the fanfold paper 20 when fed by fixing unit 8, and thus the tractor belts 91 are caused to circumferentially travel following to the movement of the fanfold paper 20 as fed by the fixing unit 8, regardless of the rotation of the drive motor, during the usual printing operation in which the fanfold paper 20 is fed by the fixing unit 8. Note, the arrangement of the tractor as described above is common to all the embodiments to be described below.

Swing lever 14 is supported on the upper surface of a tractor chassis 90 through a pin 16 substantially at the center thereof in such a manner that it can be swung in a horizontal direction and disposed perpendicularly to the feed direction of the fanfold paper. An end of the swing lever 14 is bent to a crank shape and the other end thereof has a slot 14A defined along the lengthwise direction thereof. The end of the swing lever 14 bent to the crank shape extends below the tractor chassis 90 via a through hole 90B defined thereto and is positioned in the cutout 11D of the vertically standing side of the actuation lever 11, positioned downwardly of the tractor chassis 90.

Slot 14A has an actuation arm 15A passing therethrough, which vertically downwardly extends from the end of a brake lever 15, toward which the fanfold paper 20 is fed, supported by a support bar 17 provided with a chassis (not shown) in the direction perpendicular to the feed direction of the fanfold paper (i.e., parallel to first and second shafts 92, 93).

Brake bar 15 is supported by the support bar 17 along the lengthwise direction thereof, perpendicular to the support bar 17 (in the direction parallel is the feed direction of the fanfold paper 20) in such a manner that it can be swung upward and downward, and the extreme end 15B of the brake bar 15 from which direction the fanfold paper 20 is fed is located below the first shaft 92 of the tractor 9. A plurality of mountain-shaped irregularities are defined on the upper surface of the extreme end 15B in the direction perpendicular to the lengthwise direction thereof.

Further, the friction pulley 92B is formed of an elastic material such as rubber, and is fixed to the portion of the first shaft 92 corresponding to the extreme end 15B of the brake lever 15.

The outside periphery of the friction pulley 92B is spaced apart from the irregular upper surface at the extreme end 15B of the brake lever 15 by a predetermined distance (X) in the printing state shown in FIG. 4, and when the brake lever 15 is swung in a direction enabling the extreme end 15B of the brake lever 15 to be moved upward (counterclockwise) from this state, the irregular upper surface at the extreme end 15B bites into the outside periphery of the friction pulley 92B and engages therewith.

With the aforesaid arrangement, when the actuation lever 11 is slidingly moved to the left side in the Figure in the state that a printing operation is held thereby restricting the corona charger 71 of the transfer unit 7, the vertically standing side end 11E on the right side in the Figure (located on the side from which the fanfold paper 20 is fed) of the cutout 11D of the actuation bar 11 is abutted against the swing lever 14 and thus the extreme end of the swing lever 14 where the slot 14A is formed is swung in the direction from which the fanfold paper 20 is fed, as shown by the arrow in FIG. 4. The swing motion of the swing lever 14 causes the extreme end of the actuation arm 15A of the brake bar 15 passing through the slot 14A to move in the direction from which the fanfold paper 20 is fed. As a result, as shown in FIG. 5, the brake bar 15 is swung in a direction enabling the extreme end 15B thereof to be moved upward and thus the irregular upper surface of the extreme end 15B bites into the outside peripheral surface of the friction pulley 92B and engaged therewith to prevent the rotation of the friction pulley 92B (i.e., the first shaft). More specifically, when the rotation of the first shaft 92 is prevented, the tractor belts do not circumferentially travel and thus the movement of the fanfold paper 20 is prevented.

When a printing operation is started (resumed), the vertically standing side end 11F on the left side in the FIG. 4 (toward which the fanfold paper is fed) the cutout 11D of the actuation lever 11 is abutted against the actuation lever 14 by the sliding movement of the actuation lever 11 for returning the corona charger 71 of the transfer unit 7 to a transfer position so that a swing operation opposite to that performed in the above printing operation waiting state is performed, and as a result the irregular upper surface at the extreme end 15B of the brake bar 15 Is spaced apart from the outside periphery of the friction pulley 92B to thereby release the rotation-prevented friction pulley 92B.

Note that a direction along which the swing lever 14 and brake lever 15 are swung and a mechanism by which the swing lever 14 is associated with the brake lever 15 are not limited to the aforesaid embodiment and can be suitably changed. Further, the friction pulley 92B may be mounted on the second shaft 93. Furthermore, a gear or a gear-shaped wheel may be used in place of the friction pulley 92B formed of the elastic member and the upper surface of the extreme end 15B of the brake lever 15 may be provided with a rack or irregular portion defined thereon so that the gear or the gear-shaped wheel is meshed with the rack or irregular portion. With this arrangement, the rotation of the first shaft 92 can be securely prevented.

Figure 6:
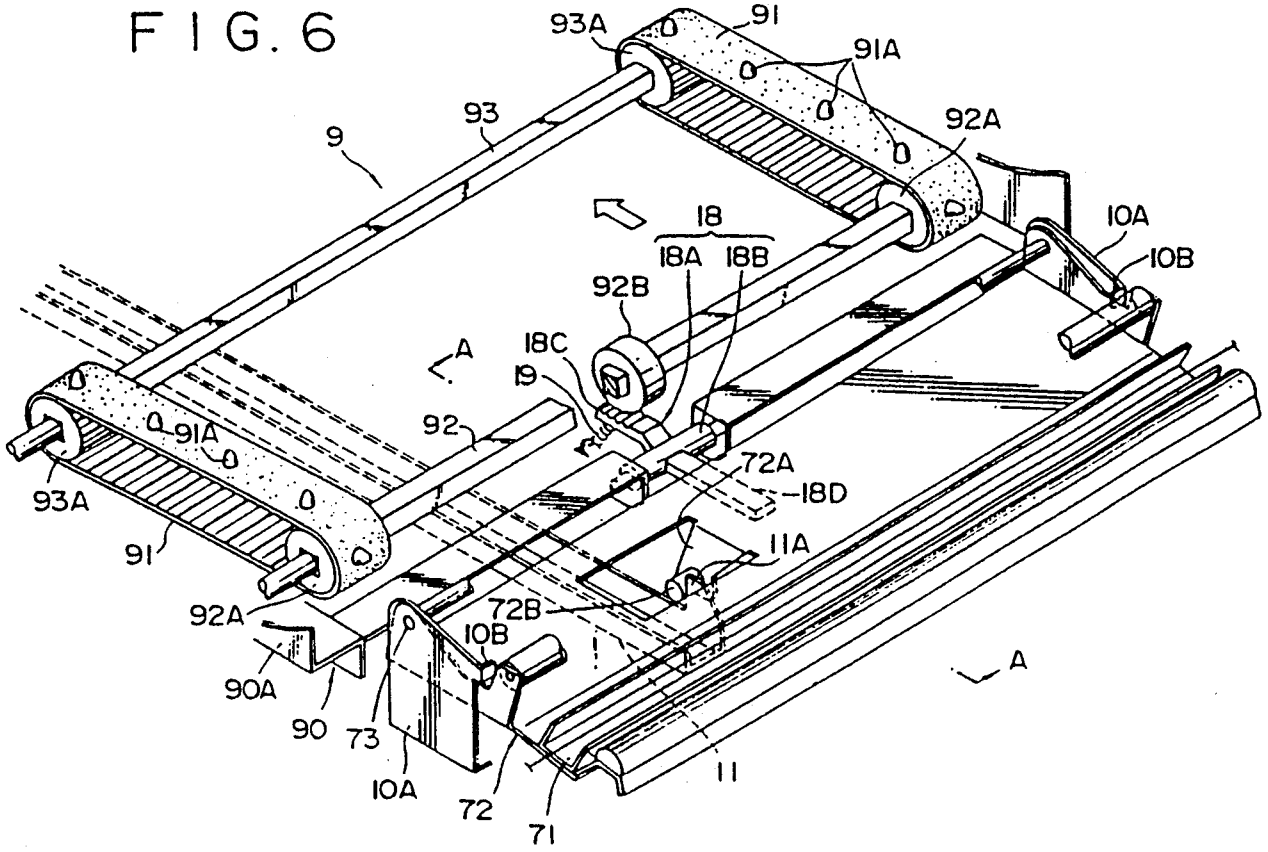
FIG. 6 is a perspective schematic view of a tractor portion showing a fourth embodiment of the present invention.
Figure 7:
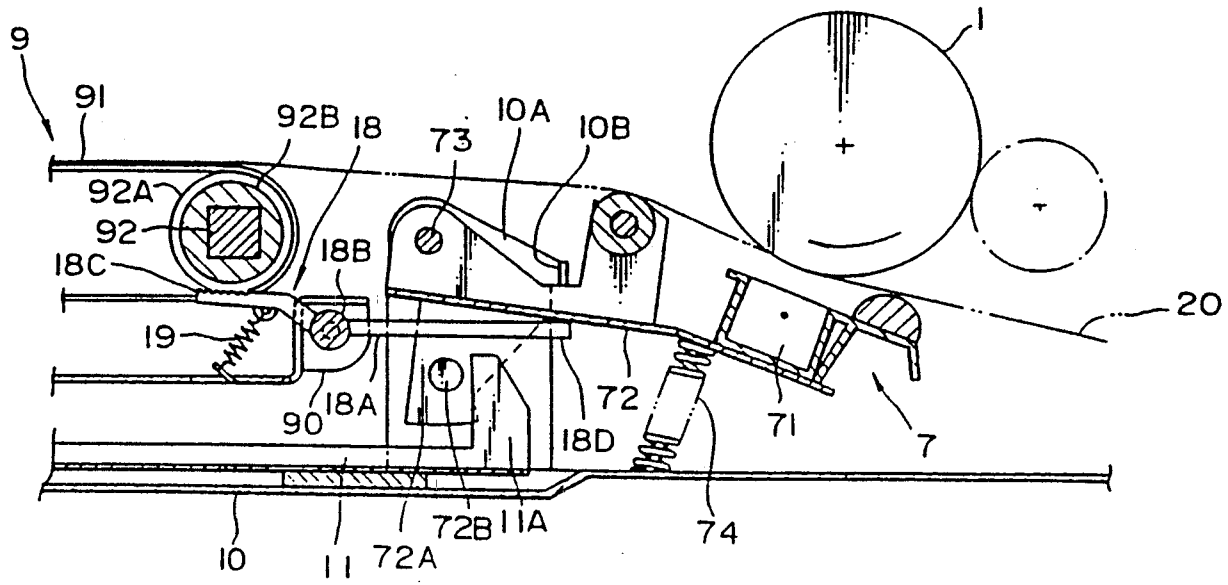
FIG. 7 is an enlarged cross sectional view of a transfer unit and a tractor portion corresponding to the A—A cross section of FIG. 6.
Figure 8:
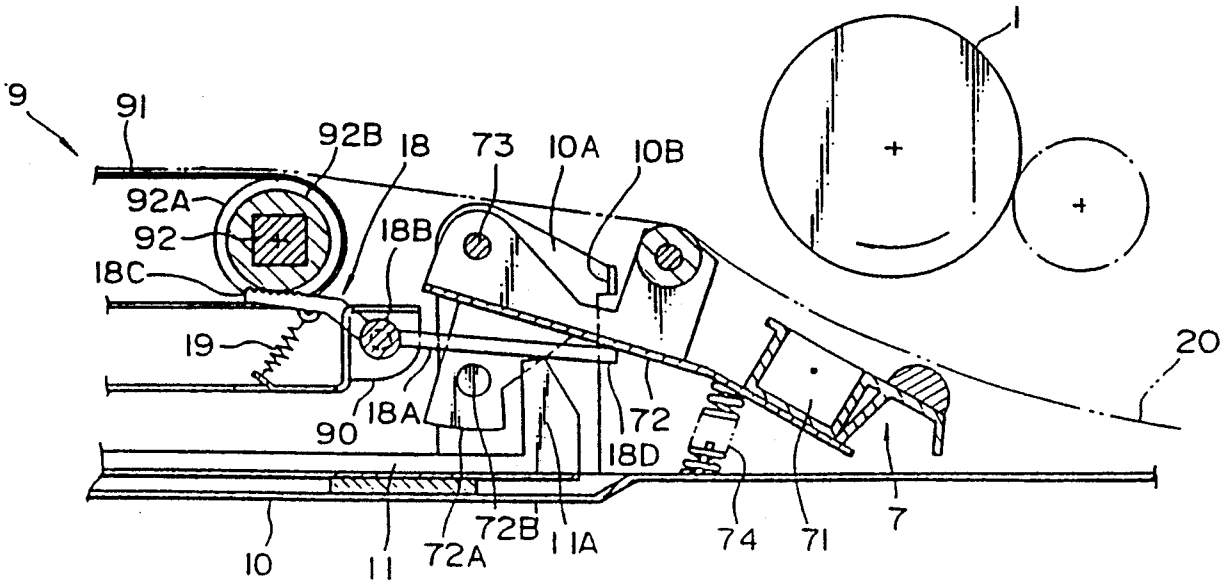
FIG. 8 is a diagram showing an operating state started from FIG. 7.

FIGS. 6 to 8 show a fourth embodiment of the present invention, wherein a stop lever 18 has a stopper member similar to the brake lever 15 in the third embodiment, which is swung in association with the swing motion of an arm 72 by which the corona charger 71 of a transfer unit 7 is held to thereby fix a friction pulley 92B mounted on a second shaft 92, and thus the circumferential travel of the tractor belts of a tractor 9 can be prevented.

As shown in the perspective view of FIG. 6 and in the cross sectional view of FIG. 7 taken along the line A—A of FIG. 6, the transfer unit 7 is arranged such that the arm 72 having the corona charger 71 disposed at the front end thereof is swingingly supported by brackets 10A, 10A at the rear end thereof through a shaft 73. Brackets 10A, 10A standing on the opposite sides in the width direction of the chassis 10 of the laser beam printing device. Arm 72 is urged and swung by a spring 74 (not shown in FIG. 6) interposed between the arm 72 and the chassis 10 in the direction along which the corona charger 71 is moved upward.

The swing motion of the arm 72 is regulated in such a manner that the upper edge on the opposite sides in the width direction of the arm 72 is abutted against the stoppers 10B of the brackets 10A positioned at the front tipper portions of the printing device and bent toward the center of the device. In this state the corona charger 71 is at a transfer position where it has a predetermined distance to the surface of a photoconductive drum 1 (not shown in FIG. 6).

An actuation arm 72A extends downward from the lower surface at a predetermined location of the arm 72 and bends. Actuation lug 72B is projected from a side of the actuation arm 72A in a width direction.

Actuation lug 72B Is positioned to the rear of the hook-shaped actuating portion 11A at the extreme end of an actuation lever 11 positioned on the lower side of a tractor chassis 90. When the actuation lever 11 is slidingly moved toward a rear direction, the actuation lug 72B is moved by the actuating portion 11A, and thus the arm 72 is swung against the urging force of the spring 74 to the side where the corona charger 71 is moved downward.

When a printing operation is put on hold the actuation lever 11 is slidingly moved backward, and thus the corona charger 71 Is retracted from the transfer position to a retracted position spaced apart from the photoconductive drum 1, as shown in FIG. 8.

Stopper lever 18 is composed of a lever portion 18A and a shaft portion 18B having a predetermined length and extending from substantially the center of the lever portion 18A in the width direction thereof to the right and left directions perpendicularly to the lever portion 18B. Extreme end 18C of the lever portion 18A, toward which the fanfold paper 20 is fed, has a plurality of mountain-shaped irregularities defined thereon perpendicularly to the lengthwise direction of the lever portion 18A. Stop lever 18 is swingingly supported, through the shaft portion 18B thereof, by the tractor chassis 90 at the end thereof from which the fanfold paper 20 is fed. Extreme end 18C of the lever portion 18A, toward which the fanfold paper 20 is fed is positioned under the friction pulley 92B which is mounted on the first shaft 92. Extreme end 18D of the lever portion 18A, from which the fanfold paper 20 is fed, is positioned under the arm 72 of the transfer unit 7. Further the extreme end 18D is positioned under the arm 72 and is swingingly urged and abutted against the lower surface of the arm 72 by a spring 19 interposed between the tractor chassis 90 and the stop lever 18.

When the arm 72 Is swung by the sliding movement of the actuation lever 11 in a rearward direction and thus the corona charger 71 is retracted in a printing operation waiting state, the stopper 18 is swung clockwise in the Figures by the swing motion of the arm 72 against the urging force of the spring 19. Irregular upper surface of the extreme end 18C thus bites into the outside periphery of the friction pulley 92B and engages therewith, as shown in FIG. 8, so that the rotation of the friction pulley 92B (i.e., the rotation of the first shaft 92) is prevented.

When a printing operation is started (resumed) and the actuation lever 11 is slidingly moved in a forward direction, the arm 72 is swung by the urging force of the spring and thus the corona charger 71 is returned to the transfer position and the stop lever 18 is released from the urged and swung state. Accordingly, the irregular upper surface of the extreme end 18A of the stop lever 18 is spaced apart from the outside periphery of the friction pulley 92B by the spring 19 to thereby release the rotation-prevented friction pulley 92B.

Figure 9:
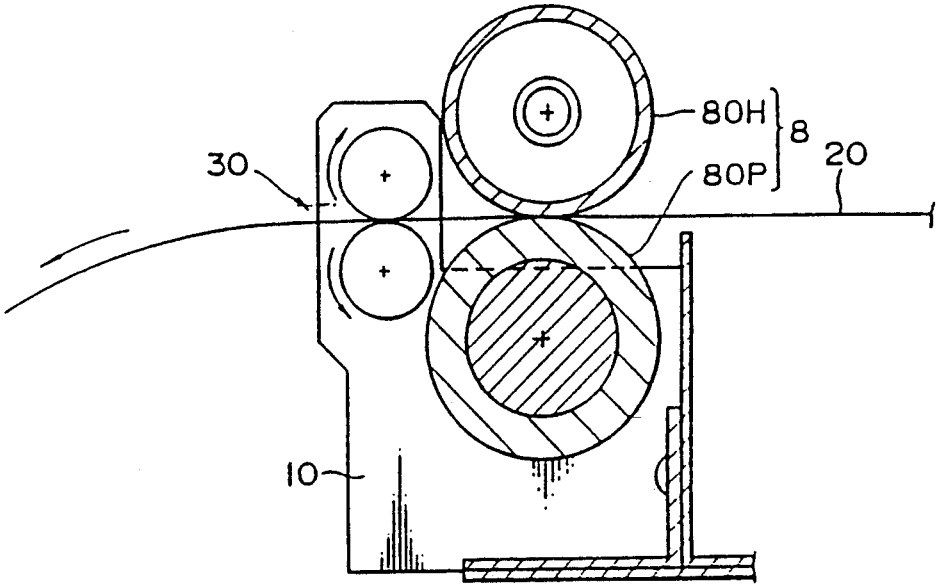
FIG. 9 is a cross sectional view of a fixing unit portion showing a fifth embodiment of the present invention.

FIG. 9 shows a fifth embodiment of the present invention.

According to the illustrated embodiment, a pair of holding rollers 50 abutted against each other by a predetermined pressing force are disposed on the paper discharge side of a fixing unit 8 and the fanfold paper 20 having been fixed and discharged from the fixing unit 8 is held therebetween. This pair of holding rollers 50 are rotated by the same drive source used for rotating the heat roller 80H of the fixing unit 80 in synchronism with the feed speed of the fanfold paper 20, and the drive source is coupled with the pair of holding rollers 50 at all times regardless of whether a printing operation is performed or held.

According to this arrangement, when the printing operation is held, the fanfold paper 20 is held between the pair of holding rollers 50 and thus the movement of the fanfold paper 20 is prevented by the pair of holding rollers 50. More specifically, although the pair of holding rollers 50 must be rotated to move the fanfold paper 20, the pair of the holding rollers 50 cannot be rotated because they are coupled with the drive source acting as a rotational resistance and thus the movement of the fanfold paper 20 can be prevented.

Figure 10:
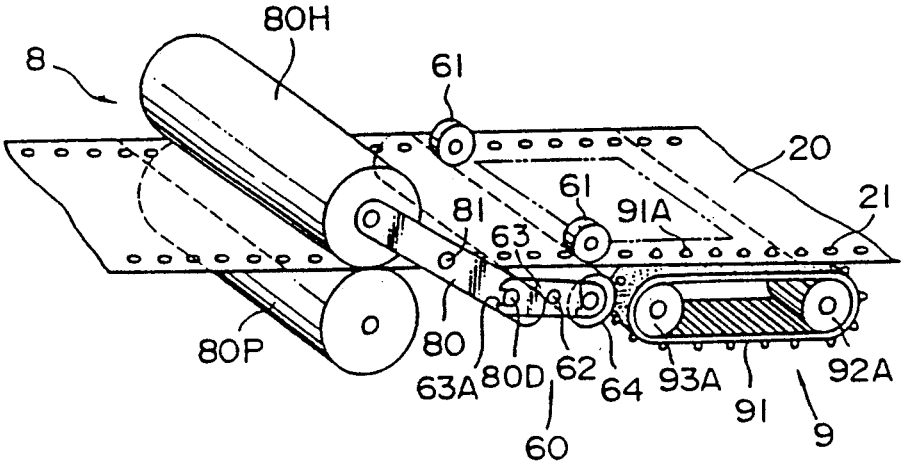
FIG. 10 is a perspective view of a tractor and fixing unit portion showing a sixth embodiment of the present invention.
Figure 11:
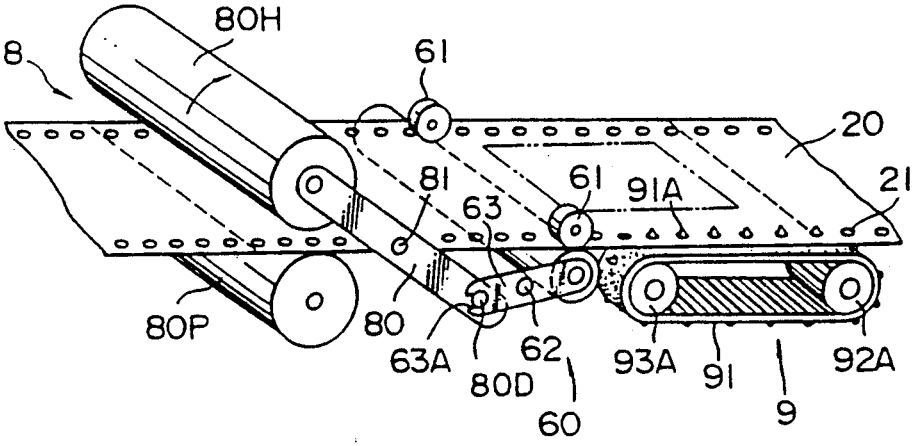
FIG. 11 is a diagram showing an operating state started from FIG. 10.

FIGS. 10 and 11 show a sixth embodiment of the present invention.

The illustrated embodiment is provided with a holding mechanism 60 which includes roller 64 interposed between a fixing unit 8 and tractor 9, faced to the feed path of the fanfold paper 20, and swung in association with the swinging retraction of the heat roller 80H1 of a fixing unit 8 and rollers 61, 61 also faced to the feed path of the fanfold paper 20. Fanfold paper 20 is fixed by being held between the roller 64 and the rollers 61, 61.

First, a mechanism for swingingly retracting the heat roller 80H will be described with reference to FIGS. 12 and 13.

Figure 12:
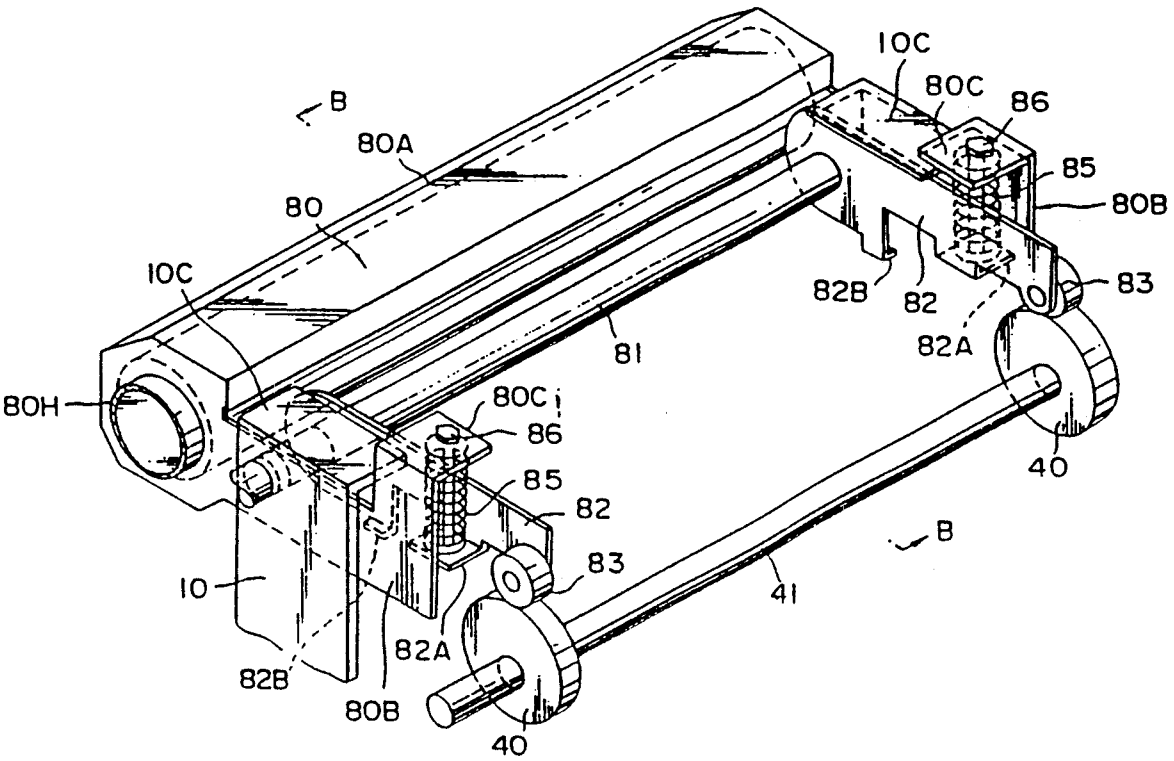
FIG. 12 is a perspective view showing the retracted state of the roller of a fixing unit.

As shown in the perspective view of FIG. 12, the heat roller 80H is supported by a holder 80 swingably provided with the chassis 10 of the laser beam printing device by using a shaft 81 as a fulcrum. When the holder 80 is swung counterclockwise in FIG. 12 about the shaft 81, the heat roller 80H is pressed against a press roller 80P below the heat roller 80H by a predetermined pressure and located at a fixing position, while when the holder 81 is swung clockwise, the heat roller 80H is spaced apart from the press roller 80P to a retracted position.

Holder 80 has a length which is substantially the same as that of the heat roller 80H, and arms 80B extend from the opposite sides of a connecting portion 80A located above the heat roller 80H to the side from which the fanfold paper 20 is introduced and supported by a chassis 10 at substantially the centers of the arms 80B through the shaft 81. Further, each of the arms 80B has a spring receiver 80C composed of a vertically standing portion and inwardly bent (bent toward the center of the device) portion and defined at the extreme end of the arm 80.

Levers 82 located inside the right and left arms 80B are swingably supported by the shaft 81 by which the arms 80B (i.e., the holder 80) are supported, respectively.

Each of the levers 82 is swingably supported at substantially the center along the lengthwise direction thereof and provided with a rotatable cam follower 83 at one side thereof (the side from which the fanfold paper 20 is introduced). Further, the lever 82 has a spring holding portion 82A bent toward the outside (the arm 80B side) and disposed at the lower side of the lever 82 corresponding to the spring receiver 80C of the holder 80 and a hook 82B disposed adjacent to the spring holding portion 82A (on the shaft 81 side) and bent and projected toward the outside.

Figure 13:
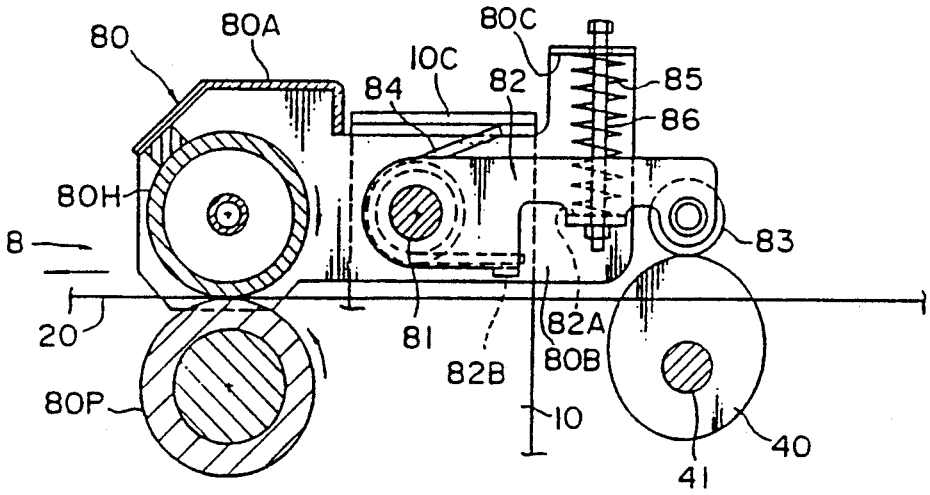
FIG. 13 is a diagram corresponding to the B—B cross section of FIG. 12.

As shown in FIG. 13, a torsion spring 84 is inserted from the outside between the arm 80B and the lever 82 of the holder 80 of the shaft 81 (this torsion spring is not shown in FIG. 12 to avoid complexity). One the of extended ends of the torsion spring 84 is located at the upper side of the hook 82B of the lever 82, and the other extended end thereof is abutted against the lower surface of a hook portion 10A formed by bending the upper side of the chassis inwardly. Lever 82 is swingingly urged clockwise in FIGS. 12 and 13 by the urged returning force of the torsion spring 84 and thus the cam follower 83, mounted at the end of the lever 83, is abutted against the outside peripheral cam surface of an eccentric cam 40 located below the cam follower 83.

Further, a coil spring 85 is interposed between the spring receiver 80C of the holder 80 and the spring holding portion 82A of the lever 82. The urging force of the coil spring 85 causes the holder 80 to be swingingly urged counterclockwise with respect to the lever 82 (i.e., in the direction along which the heat roller 80H holding side of the holder 80 is lowered) and a swing motion regulation bolt 86, passing through the spring receiver 80C, and fixed to the spring holding portion 82A regulates a relative swing amount of the holder 80 with respect to the lever 82 (on the side where an angle therebetween is increased).

More specifically, the lever 82 is urged and swung clockwise in FIG. 13 by the torsion spring 84 to cause the cam follower 83 of the lever 82 to be abutted against the eccentric cam 40 and swung according to the dislocation of the outside peripheral cam surface of the eccentric cam 40 caused by the rotation of the eccentric cam 40. Holder 80 is swung in association with the swing motion of the lever 82 through the coil spring 85 or swing motion regulation bolt 86.

As shown in FIG. 13, when the cam follower 83 is abutted against the outside peripheral cam surface of the eccentric cam 40 furthest from the center of rotation thereof (when the cam follower 83 is located at the uppermost position), the outside periphery of the heat roller 80H is abutted against the outside periphery of the press roller 80P and the swing motion of the lever 82, performed after the heat roller 80H has been abutted against the press roller 80P, causes the coil spring 85 to be compressed and deformed by a predetermined amount. Thus the heat roller 80H is pressed against the press roller 80P by a predetermine force due to the returning force of the coil spring 85 to thereby be set to a fixing operation state. On the other hand, when the cain follower 83 is abutted against the outside peripheral cam surface of the eccentric cam 40 nearest to the center of rotation thereof (when the cam follower 83 is located at the lowermost position), the holder 80 is associated with the clockwise swing motion of the lever 82 in the FIG. 13 through the swing motion regulation bolt 86 and thus the heat roller 80H is held by the holder 80 at a retracted position which is spaced apart from the press roller 80P in an upward direction.

Eccentric cam 40 is fixed to a cam shaft 41, rotatably supported by the chassis 10 in the state that it cannot be rotated relative to the cam shaft 41 and the cam shaft 41 is rotated by a drive source (not shown) controlled by a control unit (not shown) of the laser beam printing device. As shown in FIG. 13, when a printing operation is performed, the heat roller 80H is at the fixing position where the heat roller 80H is pressed against the press roller 80P by the predetermined pressure, and when the printing operation is put on hold, the heat roller 80H is at the retracted position where the heat roller 80H is spaced apart from the press roller 80P in an upward direction.

Holding mechanism 60 is disposed over the feed path of the fanfold paper 20 between the fixing unit 8, arranged as described above, and the tractor 9.

In the holding mechanism 60, the rollers 61, 61 are fixed to the chassis, respectively, at the locations on the upper side of the feed path of the fanfold paper 20 corresponding to the right and left edges (the portions where the feed holes are defined) outwardly of the area to be printed of the fanfold paper 20, in the width direction thereof, and the lock roller 64 is disposed below the rollers 61, 61 in such a manner that the feed path of the fanfold paper 20 is positioned between the lock roller 64 and the rollers 61, 61.

The lock roller 64 has a length which is substantially the same as the width of the fanfold paper 20 and each end thereof Is fixed to an end of a support arm 63 swingably supported by the chassis through a shaft 62 at substantially the center in the lengthwise direction thereof. Thus, lock rock arm 64 can be moved upward and downward by the swing motion of the support arms 63.

Slit 63A is formed at the other end of the support arm 63 along the width direction thereof and opened at the end of the support arm 63. Locking pin 80D, which is formed on the outside surface of the arm 80B of the holder 80 which supports heat roller 80H of the fixing unit 8, is engaged with the slit 63A. With this arrangement, the support arms 63 are swung in association with the swing motion of the holder 80, and when the holder 80 is swung to move the heat roller 80P to the retracted position, the support arms 63 are swung to move the lock roller 64 upward. Thus the fanfold paper 20 is held and fixed between the rollers 61, 61 disposed on the feed path of the fanfold paper 20 and the lock roller 64, so that the fanfold paper 20 cannot be moved, as shown in FIG. 11.

With the above arrangement, when a printing operation is put on hold and the heat roller 80B is retracted by the swing motion of the holder 80, the support arms 63 are swung in association with the swing motion of the holder 80 and the fanfold paper 20 is held and fixed between the lock roller 64 and the rollers 61, 61 so that the fanfold paper 20 cannot be moved. As a result, the movement of the fanfold paper 20 is prevented when a force is applied to the fanfold paper 20 for cutting off a printed portion thereof along a perforated tear line.

When the printing operation is started (resumed), the heat roller 80H is returned from the retracted position to the fixing position and the support arms 63, associated with the swing motion of the holder 80, are swung to move the lock roller 64 downward. Thus the fanfold paper 20, previously held and fixed between the lock roller 64 and the rollers 61, 61 is released to a movable state.

Note, although the holding mechanism 60 is arranged to hold the fanfold paper 20 by the roller members (lock roller 64 and rollers 61) in the above sixth embodiment, the member for holding the fanfold paper 20 is not limited thereto and, for example, a plate-shaped holding piece or the like may be used and further the mechanism by which the lock roller 64 is moved in association with the movement of the heat roller 80H of the fixing unit 8 may be suitably changed. Furthermore, the member (lock roller 64) disposed on the lower side of the fanfold paper 20 may be fixed and the members (rollers 61, 61) disposed on the upper side of the fanfold paper 20 may be arranged to hold the fanfold paper 20 by being associated with the movement of the heat roller. Further, the position where the fanfold paper 20 is held (the position where tile lock roller 64 and rollers 61 are disposed) may be located anywhere so long as it is located over the feed path of the fanfold paper 20 such as, for example, the downstream side of the fixing unit 8.

Next, a seventh embodiment of the present invention shown in FIGS. 14 to 17 will be described.

This embodiment is provided with a lock mechanism 70, between a fixing unit and a tractor 9, by which the fanfold paper 20 is fixed when a force for moving the fanfold paper 20 is applied thereto.

Figure 14:
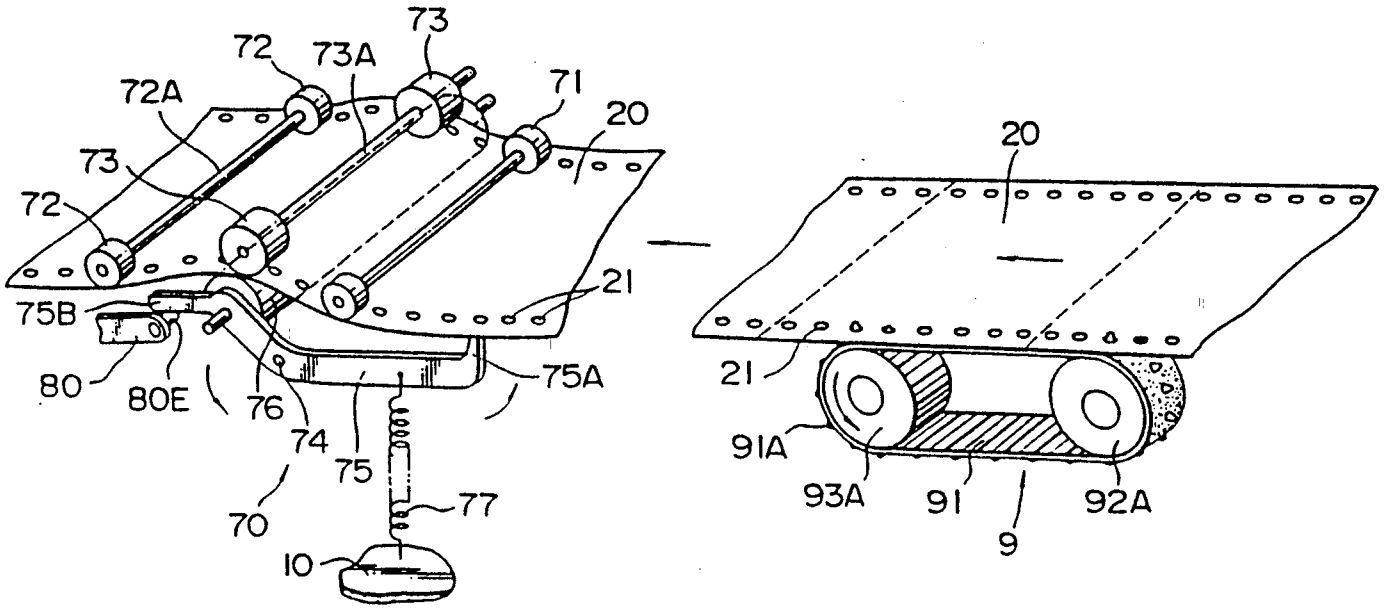
FIG. 14 is a perspective view of a tractor and fixing unit portion showing a seventh embodiment of the present invention.

As shown in the perspective view of FIG. 14, the lock mechanism has two pairs of loosely rotatable rollers 71, 72 at the locations on the upper side of the feed path of the fanfold paper 20 corresponding to the right and left edges (tile portions where the feed holes are defined) outwardly of the area to be printed of the fanfold paper 20 in the width direction thereof. Further each pair of loosely rotatable rollers 71 and 72 are rotatably disposed at locations in the front and rear directions along which the fan fanfold paper 20 is fed and are spaced apart from each other by a predetermined distance, with the lower surfaces of the outside peripheries thereof coinciding with the feed path of the fanfold paper 20. In addition, a dislocation roller 73 is disposed between the loosely rotatable rollers 71 and the loosely rotatable rollers 72 with the lower surface of the outside periphery thereof located upwardly of the loosely rotatable rollers 71, 72 by a predetermined distance, and a sensor roller 76 is disposed on the lower side of the dislocation roller 73 across the feed path of the fanfold paper 20 and rotatably supported by an end of swing arms 75 swingably supported by a chassis through a shaft 74.

Loosely rotatable rollers 71, 72 and dislocation roller 73 are rotatably mounted on shafts 71A, 72A, and 73A, respectively, which are supported by the chassis with the lengthwise direction thereof perpendicular to the feed direction of the fanfold paper 20.

Each of the swing arms 75 is disposed at the location corresponding to the feed holes of the fanfold paper 20 defined along the side edge thereof and has a lock pin 75A which can be engaged with the feed hole of the fanfold paper 20 and is formed on the upper surface of the end of the swing arm 75 where the sensor roller 76 is not supported. The location of the lock pin 75A in the feed direction of the fanfold paper 20 is set so that it coincides with location of a feed hole of the fanfold paper 20 when stopped in a printing operation waiting state.

Spring 77 has one end connected to the chassis 10 and the other end connected to the lower side of the swing arm 75 on the side thereof from which lock pin 75A is projected. Spring 77 urges the lock pin 75A away from the fanfold paper 20, and urges sensor roller 76 to swing (clockwise in FIG. 14) to the side where it approaches the dislocation roller 73. This swing motion is regulated in such a manner that the sensor roller 76 is abutted against the dislocation roller 73. More specifically, the sensor roller 76 is urgingly abutted against the dislocation roller 73 by the urging force of the spring 77. When the sensor roller 76 is abutted against the dislocation roller 73, the lock pin 75A of the swing ann 75 is positioned on the lower side of the feed path of the fanfold paper 20 in such a manner that the lock pin 75A does not interfere with the feed path.

Figure 15:
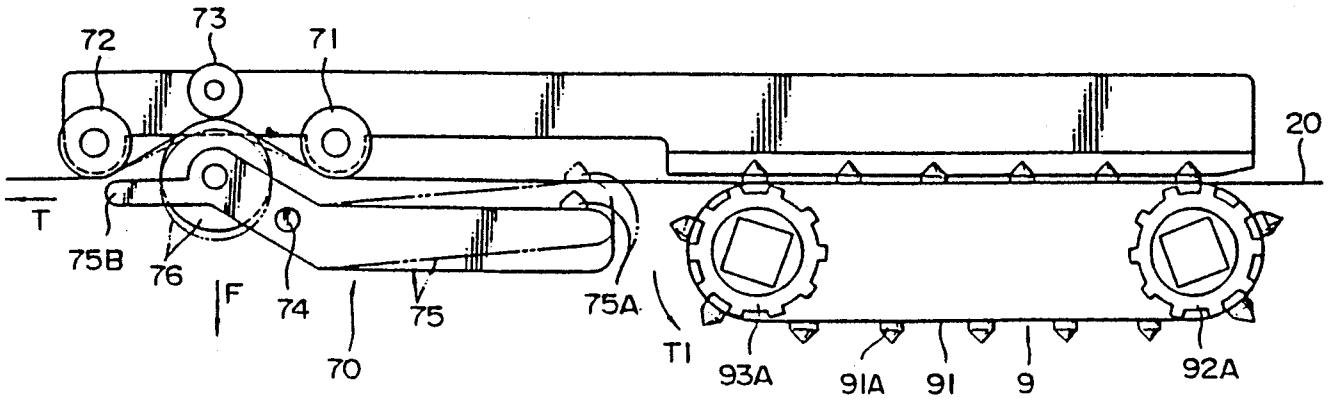
FIG. 15 is an enlarged diagram viewed from the side thereof.
Figure 16:
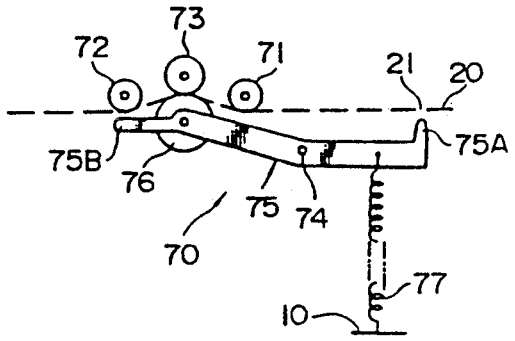
FIG. 16 is a diagram explaining a retracted state.
Figure 17:
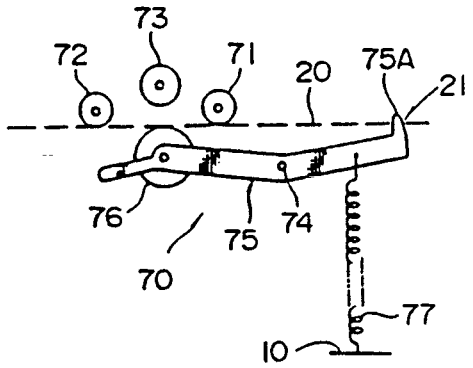
FIG. 17 is a diagram explaining an engaged state.

With this arrangement, the feed path of the fanfold paper 20 between the loosely rotatable rollers 71 and the loosely rotatable rollers 72 is bent upward by the sensor roller 76 so that it is abutted against the outside periphery of the displacement roller 73, as shown by the enlarged side view of FIG. 15.

Further, the end of swing arm 75 on the side of a fixing unit 8 is extended by a predetermined amount, and a regulating portion 80E formed by extending the end on the side of the tractor 9 of a holder 80 for holding the heat roller 80H of a fixing unit 8 is positioned on the lower side of the extended portion 75B. Thus, when the heat roller 80H is at a fixing position, the regulating portion 80E is abutted against the lower surface of the extended portion 75B of the swing arm 75 and regulates the counterclockwise swing motion of the swing arm 75 in the Figure, and when the heat roller 80H is at a retracted position, the swing arm 75 can be swung counterclockwise.

As shown in FIG. 15, a force applied to the swing arm 75 by the spring 77 is set such that when a force T or a tension generating T1 capable of causing the tractor belts of the tractor 9 to circumferentially travel is applied to the fanfold paper 20 from a paper discharge side, the sensor roller 76 is pressed downward by a force F applied thereto by the fanfold paper 20 to thereby swing the swing arm 75 counterclockwise in FIG. 15. When the swing arm 75 is swung as described above, the lock pin 75A is at the location where it interferes with the feed path of the fanfold paper 20 and thus engages with a feed hole of the fanfold paper 20.

With the above arrangement, when a printing operation is performed, the swing motion of the swing arm 75 is regulated by the regulating portion 80E of the holder 80 as shown in FIG. 14 and the fanfold paper 20 is fed between the loosely rotatable rollers 71 and the loosely rotatable rollers 72 in the state that the feed path of the fanfold paper 20 is abutted against the outside peripheral surface of the displacement roller 73 by the sensor roller 76.

When the printing operation is put on hold and the heat roller 80H is retracted by the swing motion of the holder 80, the sensor roller 76 is continuously abutted against the displacement roller 73 by the urging force of the spring 77, although the swing arm 75 can be swung. When a force for pulling the fanfold paper 20 toward the paper discharge side is applied thereto and the pulling force is a force capable of causing the tractor belts 91 of the tractor 9 to circumferentially travel, the sensor roller 76 is pressed downward by the fanfold paper 20 against the urging force of the spring 77 to thereby swing the swing arm 75 and the lock pin 75A in at the location where it interferes with the feed path of the fanfold paper 20, and thus engages with a feed hole of he fanfold paper 20, as described above and shown in FIG. 17 by the imaginary lines in FIG. 15. As a result, the movement of the fanfold paper 20 is prevented when a force is applied to the fanfold paper 20 for cutting off a printed portion thereof along a perforated tear line.

When a force is applied in the direction along which the fanfold paper 20 moves is removed, the swing arm 75 is swung by the urging force of the spring 77, the lock pin 75A is disengaged from a feed hole of the fanfold paper 20, and the sensor roller 76 is abutted against the displacement roller 73, so that the fanfold paper 20 is released from the regulation for the movement thereof.

When the printing operation Is started (resumed), the heat roller 80H Is returned to the fixing position from the retracted position, the swing motion of the swing arm 75 is prevented by the regulating portion 80E of the holder 80 and thus does not swung even if the fanfold paper 20 is fed by the fixing unit 8, and as a result a state in which a movement regulation is removed is maintained.

Note, although the lock mechanism 70 is disposed between the fixing unit 8 and the tractor 9 In the seventh embodiment, it may be disposed at a location other than the above, and in particular, when it is disposed on a paper discharge side with respect to the fixing unit 8, the mechanism (the regulating portion 80E of the holder 80) for regulating the swing motion of the swing arm 75 when the printing operation is performed can be omitted. Further, although the feed path of the fanfold paper 20 is bent by the combination of the loosely rotatable rollers 71, 72, sensor roller 76 and displacement roller 73), the mechanism for bending it is not limited thereto.

Next, an eighth embodiment of the present invention will be described with reference to FIGS. 18 to 23.

This embodiment is provided with a lock mechanism 100 arranged between a tractor 9 and a fixing unit 8 such that when the holder 80 of the fixing unit 8 is swung, a lock pin to be engaged with a feed hole of the fanfold paper 20 goes in and of the feed path thereof.

Figure 18:
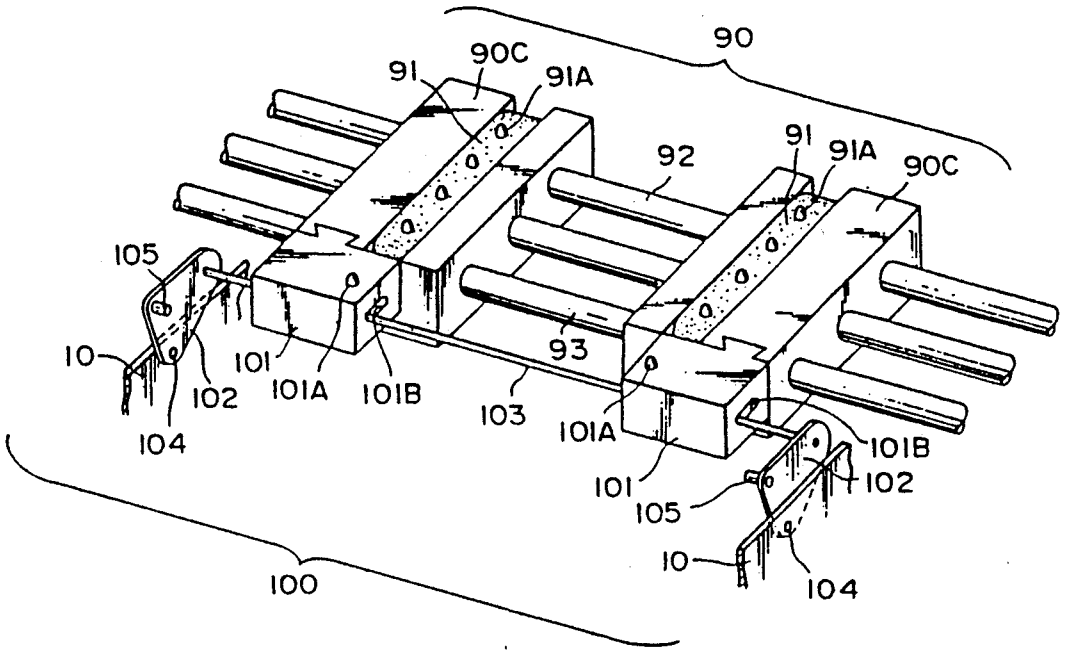
FIG. 18 is a perspective view of a locking mechanism as an eighth embodiment of the present invention.

FIG. 18 shows a partial perspective view, wherein right and left tractor frames 90C, 90C for causing the rotating direction of front and back pulleys 92A, 93A (not shown), by which each of the tractor belts 91 of a tractor 9 is rotated, to coincide with the direction in which the fanfold paper 20 is fed. Tractor frames 90C, 90C ensure that tractor belts 91 can be moved axially along first and second shafts 91, 92 so that the fanfold paper 20, having a different width, can be handled. Each of the slide members 101 of a locking mechanism 100 is vertically slidingly mounted on the vertical surface of each of the tractor frames 90C, 90C on the fixing unit side thereof.

Each of the slide members 101 is a substantially rectangular block having a dovetail formed in the height direction on the surface thereof to be attached to the tractor frame 90. Slide member 101 can be slid in a vertical direction in such a manner that the dovetail is slidingly engaged with the dovetail groove vertically defined on the vertical surface of the tractor frame 90C on the fixing unit side thereof. Further, a slot 101B, having a predetermined length, doing the front and back direction, passes through the slide member 101 in a right and left width direction. Locking pin 101A which engages with the feed hole of the fanfold paper 20, is projected from the upper surface of the slide member 101.

Location of the lock pin 101A in the width direction of the fanfold paper 20 coincides with the location projections 91A of each corresponding tractor belt 91. Lock pin 101A are arranged in the feed direction of the fanfold paper 20 and are set to coincide with the locations of the feed holes of the fanfold paper 20 when the fanfold paper 20 is stopped to wait for a printing operation. When the slide member 101 is at a lifted location, the lock pin 101A interferes with the feed path of the fanfold paper 20 and is engages with a feed hole thereof. When the slide member 101 is at the lowermost location within the lifting and lowering range thereof, the lock pin 101A is retracted from the feed path of the fanfold paper 20 and is disengaged from the feed hole.

Actuation shaft 103 extends between right and left link levers 104 swingably attached to chassis 10 through pins 104. Actuation shift 103 is slidingly passed through the slots 101B.

Each link lever 102 is formed to a substantially inverse triangular shape and attached to the chassis 10 through the pin 104 at the lower corner thereof. Actuation shaft 103 is fixed to one of the corners of link lever 102 on the tractor side thereof, and a pin 105, to be actuated, is provided on the other corner.

Figure 19:
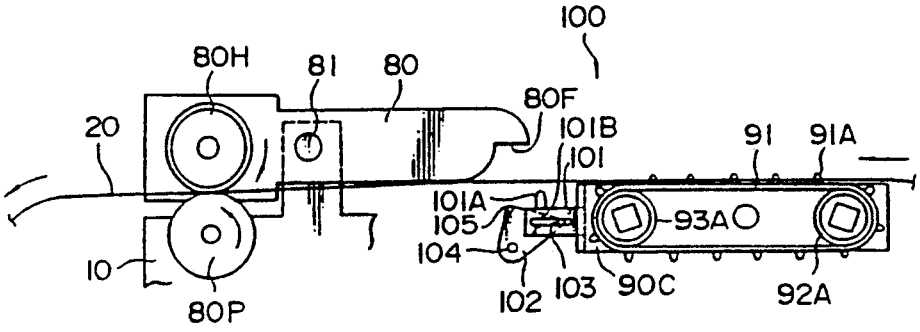
FIG. 19 is a side view of a tractor and fixing unit.
Figure 20:
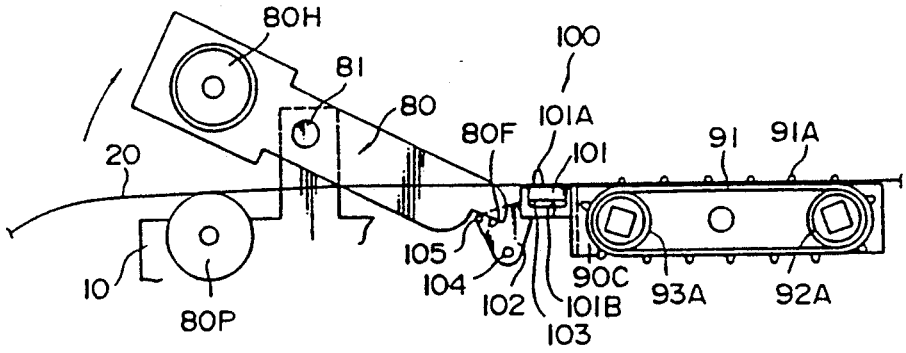
FIG. 20 is a diagram showing the operating state thereof.

As shown in FIGS. 19 and 20, the pin 105 to be actuated is positioned below the actuation end 80F of the holder 80 of the fixing unit 8 which is extended toward the tractor side. Pin 105 is actuated by the actuation end 80F of the holder 80 when the holder 80 is swung clockwise in FIG. 18 to retract the heat roller 80H.

When the pin 105 to be actuated Is actuated by the actuation end 80F of the holder 80, the link lever 102 is swung counterclockwise in FIG. 19, whereby the actuation shaft 103 is slidingly moved in the slot 101B of the slide member 101 to thereby move the slide member 101 upward, as shown in FIG. 20. Note that the slide member 101 is at the lowermost end within a lifting and lowering range due to the gravitational effects of its own in a free state in which pin 105 is not actuated by the actuation end 80F of the holder 80.

With the above arrangement, when a printing operation is put on hold and the heat roller 80H is retracted by the swing motion of the holder 80, the link lever 102 is swung counterclockwise by the actuation end 80F, the slide member 101 is lifted, and thus the lock pin 101A Is at the location where it interferes with the feed path of the fanfold paper 20 and engages with a feed hole thereof. As a result, the movement of the fanfold paper 20 is prevented when a force is applied to the fanfold paper 20 for cutting off a printed portion thereof along a perforated tear line.

When the printing operation Is started (resumed), the heat roller 80H is returned from the retracted position to a fixing position and the swing actuation of the link lever 102 which has been effected by the actuation end 80F of the holder 80, is released, and thus the slide member 101 is lowered to the lowermost end within the lifting and lowering range due to gravitational effects on the weight thereof and the lock pin 101A disengages from a feed hole of the fanfold paper 20, whereby the fanfold paper 20 is permitted to be moved.

Figure 21:
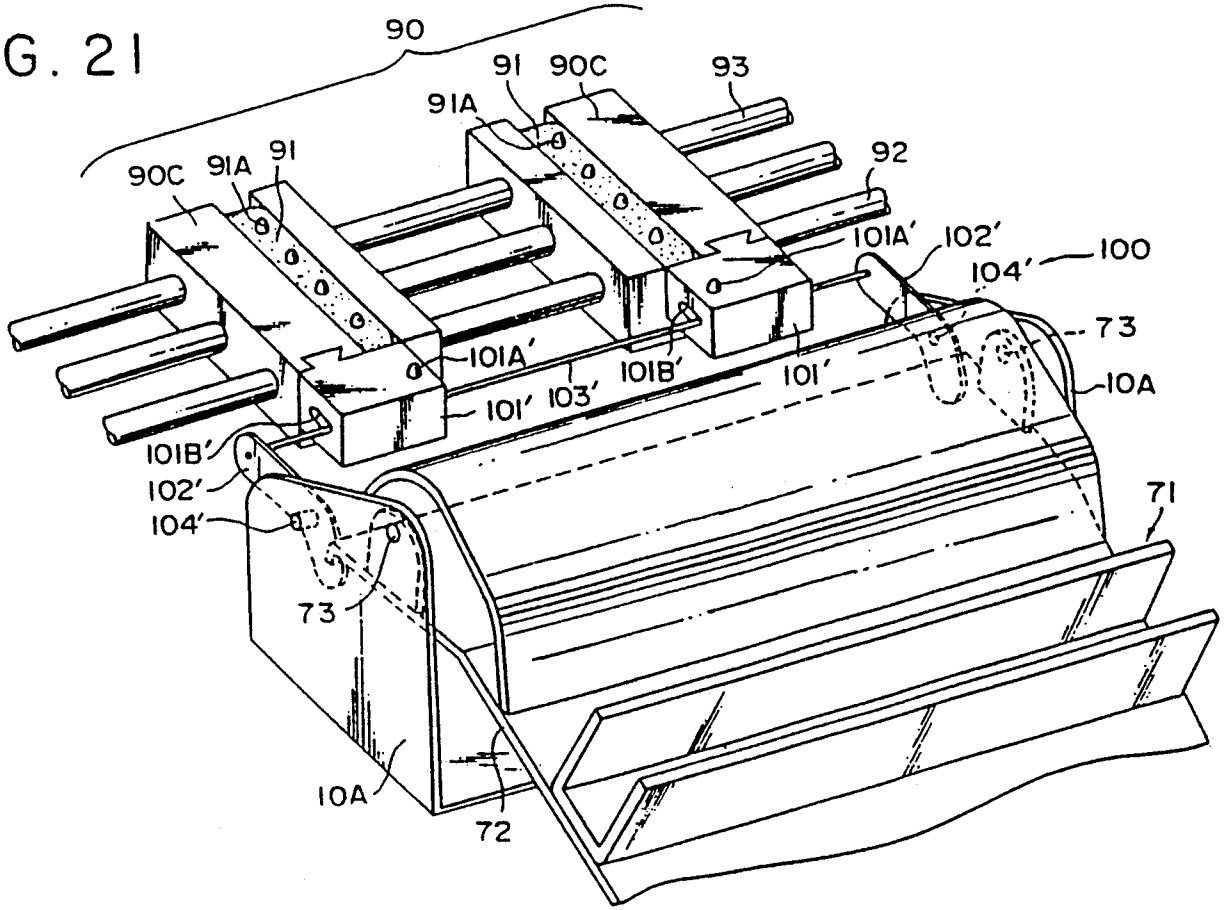
FIG. 21 is a perspective view of a locking mechanism as a modification of the eighth embodiment.
Figure 22:
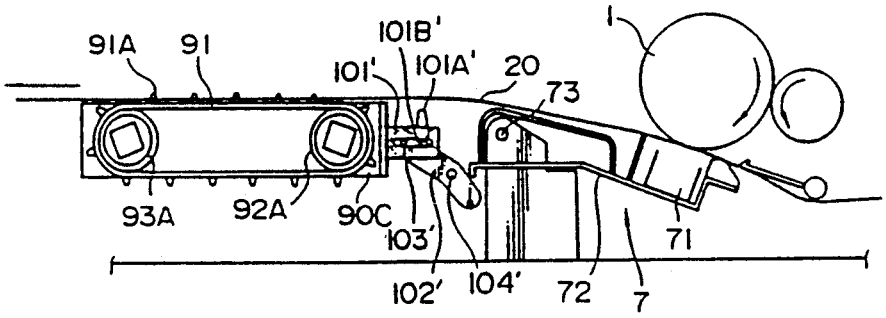
FIG. 22 is a side view of a tractor and transfer unit.
Figure 23:
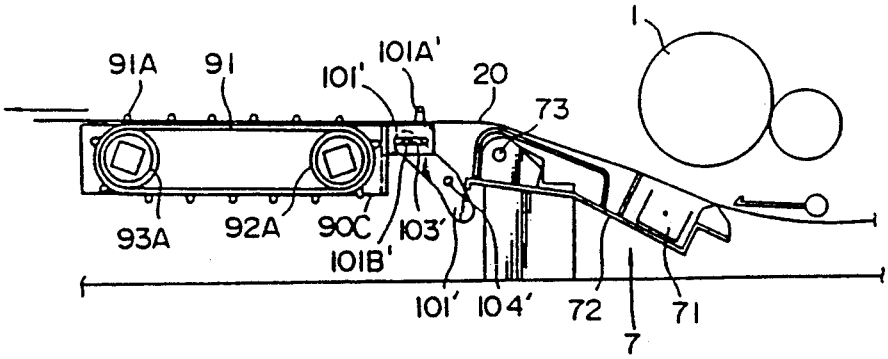
FIG. 23 is a diagram showing the operating state thereof.

Note, although the lock mechanism 100 is disposed between the fixing unit 8 and the tractor 9 in the above arrangement, It may be disposed at any other suitable location, and it is contemplated, for example, that the lock mechanism 100 be disposed between the tractor 9 and a transfer unit 7 as shown in FIGS. 21 to 23. More specifically, in the illustrated arrangement, slide members 101' arranged in the same way as those described above are vertically movably mounted on the vertical surfaces of the right and left tractor frames 90C, 90C of the tractor 90 on the transfer unit side thereof. Slide members 101' are vertically moved by an actuation shaft 103' bridged between right and left substantially "sloping-roof-corner-shaped" link levers 102'which are rotatably attached to the chassis 10 through pins 104' in the vicinity of the bent portion thereof. As shown in FIG. 23, when a corona charger 71 is at a retracted location, the ends of each of the link levers 102' on the transfer unit side thereof are turned clockwise in FIG. 23 by the end of an arm 72, on the tractor side thereof for holding the corona charger 71 to enable the same to be retracted. With this arrangement, each of the slide members 101' is moved upward, whereby a locking pin 101A, as locking pins 101A location where the feed of the fanfold paper 20 is interfered, as locking pins 101A engage engaged with the feed holes of fanfold paper 70. Further, the mechanism by which the slide member 101 is lifted or lowered in association with the swing motion of the holder 80 of the fixing unit 8, or the arm 72 of the transfer unit 7, is not limited to the above embodiments. Although all of the aforesaid first to eighth embodiments have been described as applied to a laser beam printing device making use of an electrophotographic method, a printer to which these embodiments are applied is not limited thereto, and they can be applied to any printer such as, for example, a wire dot printer, thermal transfer printer and the like, so long as they are arranged such that a fanfold paper waiting for a printing operation is moved by a force applied thereto.

The present disclosure relates to subject matters contained in Japanese Patent Applications Nos. HEI3-185946 (filed on Apr. 23, 1991) and HEI3-319862 (filed on Nov. 6, 1991), Japanese Utility Model Applications Nos. HEI3-97914 (filed on Oct. 31, 1991) and HEI3-104087 (filed on Nov. 22, 1991), and Japanese Patent Application which has not been assigned yet (filed on Apr. 15, 1992) which are expressly incorporated herein by reference in their entireties.

What is claimed is:

1. A paper feed lock mechanism adapted to be used with a printer for printing continuous recording paper, said paper feed lock mechanism comprising recording paper movement regulation means for regulating movement of said continuous recording paper during predetermined times when no printing operation is performed by said printer, said regulation means comprising means for applying a load to said continuous recording paper for preventing movement of said continuous recording paper, said regulation means regulates movement of the continuous recording paper when a fixing roll is separated from the continuous recording paper.

2. The paper feed lock mechanism for a printer according to claim 1, wherein said continuous paper comprises feed holes defined along side edges of said paper and said printer is provided with tractor belts which each comprise projections that are adapted to engage said feed holes, said tractor belts circumferentially traveling in synchronism with said continuous recording paper; wherein said recording paper movement regulation means regulates said circumferential traveling movement of said tractor belts.

3. The paper feed lock mechanism for a printer according to claim 2, wherein each of said tractor belts is stretched between drive pulleys mounted on shafts, respectively, and at least one of said shafts is connected to a member through a clutch means which enables said shaft to be connected or disconnected from driving said member, said member being stationary when a printing operation is not being performed and having a rotational load larger than a predetermined value when rotated.

4. The paper feed lock mechanism for a printer according to claim 3, wherein said member which is stationary when a printing operation is not being performed, and which has a rotational load larger than a predetermined value when rotated, comprises means for driving said tractor belts to circumferentially travel.

5. The paper feed lock mechanism for a printer according to claim 2, wherein each of said tractor belts is stretched between a drive pulley mounted on a drive shaft and a follower pulley mounted on a follower shaft, each of said tractor belts being caused to circumferentially travel in a direction toward which said continuous paper is fed, through a drive force transmission means mounted on said drive shaft and engaged with said drive shaft when rotated in the direction toward which said continuous paper is fed, to thereby transmit a rotating force to said drive shaft through one way engagement means, and loosely rotated when rotated in a direction opposite to said direction toward which said continuous paper is fed, said recording paper movement regulation means further comprising:

first drive force transmission means integrally formed with said drive force transmission means mounted on said shaft; and second drive force transmission means mounted on said follower shaft and loosely rotated when rotated in the direction toward which said continuous paper is fed, said second drive force transmission means being engaged with said follower shaft to thereby transmit a rotating force to said follower shaft through one way engagement means when rotated in an opposite direction, said first drive force transmission means being coupled with said second drive force transmission means through an association means; and said first drive force transmission means and said second drive force transmission means are arranged such that when said tractor belts circumferentially travel, said second drive force transmission means is rotated at a speed higher than that of said follower shaft.

6. The paper feed lock mechanism for a printer according to claim 5, wherein said first drive force transmission means and said second drive force transmission means comprise toothed pulleys, and said association means is a toothed belt.

7. The paper feed lock mechanism for a printer according to claim 2, wherein each of said tractor belts is stretched between drive pulleys mounted on a drive shaft and a follower pulley mounted on a follower shaft which is adapted to circumferentially travel in a direction toward which said continuous paper is fed, through a drive force transmission means mounted on said drive shaft and engaged with said drive shaft when rotated in a direction toward which said continuous paper is fed to thereby transmit a rotating force to said drive shaft through one way engagement means, said follower pulley being loosely rotated when rotated in a opposite direction, said recording paper movement regulation means comprising:

said follower pulley which is mounted on said follower shaft so that when said follower pulley is rotated in the direction toward which said continuous paper is fed, said follower pulley engages said follower shaft to thereby transmit a rotational force to said follower shaft through one way engagement means, and so that when said follower pulley is rotated in an opposite direction, said follower pulley is loosely rotated;

a first drive force transmission means integrally attached to said drive force transmission means which is mounted on said drive shaft;

a second drive force transmission means mounted on said follower shaft so that said first and second drive force transmission means cannot be relatively rotated, wherein said first drive force transmission means is coupled with said second drive force transmission means through an association means; and said first drive force transmission means and said second drive force transmission means being arranged such that when said tractor belts circumferentially travel, said second drive force transmission means is rotated at a speed higher than the speed of second follower shaft.

8. The paper feed lock mechanism for a printer according to claim 7, wherein said first drive force transmission means and said second drive force transmission means comprise toothed pulleys, and said association means is a toothed belt.

9. The paper feed lock mechanism for a printer according to claim 2, wherein said recording paper movement regulation means comprises a stopper means associated with a change in status of said printer, from a printing operation to a printing operation waiting state, for regulating rotation of a shaft member on which a pulley for stretching said tractor belts is mounted.

10. The paper feed lock mechanism for a printer according to claim 9, wherein said stopper means comprises a swingable arm member having an engagement portion at an extreme end of said arm member, said arm member being adapted to swing in association with the change of status of said printer from a printing operation state to a printing operation waiting state, and an engagement member fixed on said shaft member and engaged with said arm member.

11. The paper feed lock mechanism for a printer according to claim 10, wherein said printer is provided with a movement member which is adapted to move between the time when a printing operation is performed and a time when said printer is waiting for a printing operation to be performed, and wherein said arm member is swung in association with said movement member.

12. The paper feed lock mechanism for a printer according to claim 10, wherein said printer comprises an electrophotographic printer provided with a fixing unit for performing a fixing action by using a pair of fixing rolls, wherein, when said printer is waiting for a printing operation to be performed, at least one of said fixing rolls is spaced apart and retracted from said continuous recording paper, wherein said arm member is swung in association with retraction of said at least one roller.

13. The paper feed lock mechanism for a printer according to claim 10, said printer comprising an electrophotographic printer wherein, when said printer is waiting for a printing operation to be performed, a transfer charger is retracted from a transfer position and said arm member is swung in association with retraction of said transfer charger.

14. The paper feed lock mechanism for a printer according to claim 2, wherein said recording paper movement regulation means comprises an engagement member which is adapted to engage feed holes of said continuous recording paper in association with a change of state of said printer from a printing operation state to a printing operation waiting state.

15. The paper feed lock mechanism for a printer according to claim 14, wherein said engagement member is adapted to be engaged with the feed holes of said continuous recording paper, at the time that a swingable arm member having an engagement projection adapted to be engaged with the feed holes of said continuous recording paper, is adapted to be swung in association with the change of state of said printer from a printing operation state to a printing operation waiting state, said engagement projection being located at an extreme end of said swingable arm member.

16. The paper feed lock mechanism for a printer according to claim 15, wherein said printer is provided with a movement member which is adapted to be moved between the time when a printing operation is performed and the time when said printer is waiting for a printing operation to be performed, and wherein movement of said arm member is associated with said movement member.

17. The paper feed lock mechanism for a printer according to claim 15, wherein said printer comprises an electrophotographic printer and is provided with a fixing unit for performing a fixing action by using a pair of fixing rolls, wherein, when said said printer is waiting for a printing operation to be performed, at least one of said pair of fixing rolls is spaced apart and retracted from said continuous recording paper, wherein said arm member is associated with retraction of one roller of said pair of fixing rolls.

18. A paper feed lock mechanism for a printer according to claim 15, wherein said printer comprises an electrophotographic printer, wherein, when said printer is waiting for a printing operation to be performed, a transfer charge is retracted from a transfer position, wherein movement of said engagement member is associated with retraction of said transfer charge.

19. The paper feed lock mechanism for a printer according to claim 1, wherein said recording paper movement regulation means comprises a pair of rollers adapted to be pressed against each other with said continuous recording paper held between said pair of rollers, wherein at least one of said rollers is rotated in synchronism with feeding movement of said continuous recording paper.

20. The paper feed lock mechanism for a printer according to claim 19, wherein said printer comprises an electrophotographic printer and said pair of rollers are disposed on a paper discharge side of a fixing unit which forms part of said printer.

21. The paper feed lock mechanism for a printer according to claim 1, wherein said recording paper movement regulation means includes gripping means operatively associated with a change of state of said printer from a printing operation state to a printing operation waiting state, said gripping means comprising means for gripping said continuous recording paper to prevent movement of said recording paper when said printer is waiting for a printing operation to be performed.

22. The paper feed lock mechanism for a printer according to claim 21, wherein said gripping means includes a fixing member fixedly disposed on one side of the feed path of said continuous recording paper, and a pressing member fixed to an arm member swingably supported by a chassis member on an opposite side of said feed path, across said continuous recording paper, wherein when said printer is waiting for a printing operation to be performed, said continuous recording paper is gripped between said pressing member and said fixing member, by the swinging motion of said arm member, to thereby prevent movement of said continuous recording paper.

23. The paper feed lock mechanism for a printer according to claim 22, wherein said printer is provided with a moving member which is adapted to be moved between the time when a printing operation is performed and the time when said printer is waiting for a printing operation to be performed, wherein said arm member is associated with said movement member.

24. The paper feed lock mechanism for a printer according to claim 22, wherein said printer comprises an electrophotographic printer provided with a fixing unit for performing a fixing operation by using a pair of fixing rolls, wherein, when said printer is waiting for a printing operation to be performed, at least one of said pair of fixing rolls is spaced apart from and retracted from said continuous recording paper, wherein movement of said arm member is associated with retraction of a roller of said at least one pair of fixing rolls.

25. The paper feed lock mechanism for a printer according to claim 22, wherein said printer comprises an electrophotographic printer, wherein when said printer is waiting for a printing operation to be performed, a transfer charger is retracted from a transfer position, wherein movement of said arm member is associated with retraction of said transfer charger.

26. The paper feed lock mechanism for a printer according to claim 1, wherein said recording paper movement regulation means comprises an arm member having a guide portion defined at one end of said arm member and an engagement projection adapted to be engaged with a feed hole of said continuous recording paper, said engagement projection located at a second end of said arm member, said arm member adapted to be swung in a direction perpendicular to the direction toward which said continuous recording paper is fed, urging means for urging and swinging said arm member to press said guide portion against said continuous recording paper and to bend the feed path of said paper, wherein, when tension is applied to said continuous recording paper, said arm member is swung against the urging force of said urging means to cause said engagement projection to engage the feed hole of said continuous recording paper.

27. A paper movement locking mechanism adapted for use in a printer for printing on continuous paper, said printer being capable of printing during printing periods and not printing during non-printing periods, said mechanisms including a locking device comprising means for preventing movement of said continuous recording paper during predetermined non-printing periods, said preventing means comprising means applying a load to said paper for preventing movement of said continuous paper, said preventing means regulates movement of the continuous paper when a fixing roller is separated from said paper.

28. A mechanism in accordance with claim 27, wherein said movement preventing means comprises a one-way clutch.

29. A mechanism in accordance with claim 28, wherein said printer includes means for feeding said continuous paper through said printer, said feeding means including at least one belt positioned about a plurality of pulleys, at least one of said pulleys being connected to one end of a first shaft, said first shaft being connected at an opposite end to said one-way clutch.

30. A mechanism in accordance with claim 29, wherein each said belt has a plurality of teeth on an interior belt surface, said belt teeth being adapted to engage teeth on an exterior surface of said pulleys.

31. A mechanism in accordance with claim 29, wherein an exterior surface of each said belt comprises a plurality of projections which are adapted to engage holes in said continuous paper.

32. A mechanism in accordance with claim 29, wherein said clutch, when engaged, couples said first shaft to a drive motor, wherein when said drive motor is stationary it comprises a rotational load on said first shaft to prevent movement of said continuous paper.

33. A mechanism in accordance with claim 29, further comprising a drive gear attached to said one-way clutch, wherein said drive gear, when rotated in a predetermined direction, engages said one-way clutch to permit said first shaft to be driven in accordance with the direction of feeding movement of said paper.

34. A mechanism in accordance with claim 33, wherein said drive gear, when driven in a direction opposite to said predetermined direction, disengages said one-way clutch and causes said drive gear to be loosely rotated with respect to said first shaft.

35. A mechanism in accordance with claim 29, wherein said feeding means further comprises means for driving said fanfold paper through said printer at a speed which is faster than the circumferential travel speed of each said belt during a normal printing operation.

36. A mechanism in accordance with claim 29, further comprising a second one-way clutch which is adapted to be attached to a second pulley at one end of a second shaft which is attached to said second pulley.

37. A mechanism in accordance with claim 36, wherein said second one-way clutch, when disengaged in a predetermined rotational direction, comprises means for permitting said second pulley to be loosely rotated with respect to said second shaft.

38. A mechanism in accordance with claim 37, wherein said second one-way clutch, when engageably rotated in a predetermined rotational direction, comprises means for rotating said second shaft in accordance with rotation of said second pulley.

39. A mechanism in accordance with claim 36, wherein said first and second clutches together comprises means for locking each said belt in a predetermined position to prevent movement of paper on said belt.

40. A mechanism in accordance with claim 38, wherein said second pulley has a diameter smaller than the diameter of said first pulley.

41. A mechanism in accordance with claim 27, wherein said one-way clutch comprises an electromagnetic clutch.

42. A mechanism in accordance with claim 27, wherein said movement preventing means comprises a movable member which is adapted to engage paper feeding means in said printer in order to prevent movement of said paper.

43. A mechanism in accordance with claim 42, wherein said movable member comprises a brake lever.

44. A mechanism in accordance with claim 42, wherein said paper feeding means comprises at least one belt and at least two rotatable pulleys positioned on respective first and second shafts.

45. A mechanism in accordance with claim 44, wherein said moveable member comprises a brake lever which is adapted to fix the position of at least one of said pulleys to prevent each of said belts from moving.

46. A mechanism in accordance with claim 45, wherein said brake lever is supported by a swing lever which is attached to a chassis for supporting each said belt.

47. A mechanism in accordance with claim 45, wherein said brake lever is supported by a bar, said brake lever being swingable both upwardly and downwardly.

48. A mechanism in accordance with claim 45, wherein one end of said brake lever comprises an irregularly shaped surface which is adapted to engage a friction pulley attached to one of said first and second shafts.

49. A mechanism in accordance with claim 48, wherein said friction pulley has an outer periphery which is spaced apart from said end of said brake lever by a predetermined distance when said printer is engaged in a printing operation, and which engages said brake lever during said predetermined non-printing periods.

50. A mechanism in accordance with claim 42, wherein said movable member comprises a swingable stop lever.

51. A mechanism in accordance with claim 50 , wherein said stop lever is pivotally connected to an arm of a corona charger.

52. A mechanism in accordance with claim 51, said paper feeding means comprising at least one belt adapted to drive said continuous paper, at least one pulley, and at least two spaced shafts.

53. A mechanism in accordance with claim 52, wherein said stop lever is a pivotal member which is adapted to engage a friction pulley mounted on one of said shafts in order to prevent movement of each said belt.

54. A mechanism in accordance with claim 53, wherein said apparatus further comprises a slidable actuation lever having an actuating portion at one end.

55. A mechanism in accordance with claim 54, wherein said one end of said actuation lever is adapted to engage an actuation arm which is adapted to pivotally move said stop lever.

56. A mechanism in accordance with claim 52, wherein said step lever includes a shaft portion and a lever portion with one end having an irregular surface, said irregular portion being adapted to engage a friction pulley mounted on one of said shafts.

57. A mechanism in accordance with claim 50, further comprising a spring for biasing said stop lever into a first position during printing operation of said printer.

58. A mechanism in accordance with claim 50, wherein said feeding means include at least one belt, at least two rotatable shafts, and at least one friction pulley positioned on at least one of said shafts, wherein said stop lever is adapted to be rotated in a first direction in order to engage said friction pulley in order to prevent rotation of said at least one shaft and movement of said paper during one of said predetermined non-printing periods.

59. A mechanism in accordance with claim 58, wherein said stop lever is rotated in a direction opposite to said first direction in order to move said stop lever into a position in which it is spaced from said pulley, during a time other than one of said predetermined non-printing periods.

60. A mechanism in accordance with claim 27, wherein said movement preventing means comprises a pair of rollers.

61. A mechanism in accordance with claim 60, wherein said printer includes an image fixing unit, said pair of rollers forming part of said image fixing unit.

62. A mechanism in accordance with claim 61, wherein said pair of rollers comprise holding rollers which are coupled to a drive source for rotating a heat roller in said fixing unit, said drive source comprising means for preventing said holding rollers from rotating during said predetermined non-printing periods.

63. A mechanism in accordance with claim 27, wherein said movement preventing means comprises a roller positioned between an image fixing unit, forming part of said printer, and means for feeding paper through said printer.

64. A mechanism in accordance with claim 63, wherein said feeding means comprises at least two spaced belts for feeding said continuous paper.

65. A mechanism in accordance with claim 63, wherein said roller comprises a locking roller which is adapted to engage two spaced rollers positioned on opposite side edges of said paper, in order to prevent said paper from moving during said predetermined non-printing periods.

66. A mechanism in accordance with claim 65, wherein said locking rollers is movable into a second position, spaced from said paper, to permit said paper to be fed.

67. A mechanism in accordance with claim 63, wherein said roller is connected to a heating roller forming part of said image fixing unit.

68. A mechanism in accordance with claim 67, wherein said roller is attached to said heating roller by a pivotable holder.

69. A mechanism in accordance with claim 63, said roller comprising a locking roller, said mechanism further comprising two additional spaced rollers which are adapted to be attached to said printer above a paper feeding path, said locking roller being positioned below said paper feeding path, wherein said path is positioned between said spaced apart rollers and said locking roller.

70. A mechanism in accordance with clam 69, wherein said locking roller has a length substantially equal to the width of said paper, said locking roller having opposite ends which are attached to a support arm which is adapted to be pivotally supported, via a shaft, to said printer.

71. A mechanism in accordance with claim 63, said fixing unit comprising a holder attached to a heater roller, said holder being adapted to move said heating roller between a retracted position during at least said predetermined periods, and an actuated position during said printing periods, said roller being attached to said holder.

72. A mechanism in accordance with claim 71, wherein said holder comprises means for simultaneously retracting said heat roller and moving said roller into a locking position to prevent said paper from moving during said predetermined non-printing periods.

73. A mechanism in accordance with claim 72, said simultaneously moving and retracting means further comprising means for simultaneously moving said heating roller into a fixing position and said roller into a release position in order to permit movement of said paper.

74. A mechanism in accordance with claim 27, wherein said movement preventing means comprises at least one locking pin which is adapted to engage holes in said paper.

75. A mechanism in accordance with claim 74, comprising two spaced apart locking pins which are adapted to engage holes on opposite edges of said paper.

76. A mechanism in accordance with claim 75, wherein each of said locking pins projects upwardly from a pivotable arm which is attached to a roller positioned under said paper at a location spaced apart from said pins, as viewed in a direction along which said paper is adapted to travel through said printer.

77. A mechanism in accordance with claim 75, wherein each of said pins is attached to the end of a spring-biased arm which is movably connected to a heat roller in a fixing unit which forms part of said printer.

78. A mechanism in accordance with claim 75, wherein said pins do not engage holes on said paper during said printing periods, and engage said holes during said predetermined non-printing periods.

79. A mechanism in accordance with claim 74, further comprising a plurality of rollers positioned above and below a path along which said paper is adapted to be fed through said printer.

80. A mechanism in accordance with claim 79, said rollers including two spaced, loosely rotatable rollers positioned above said path, a dislocation roller positioned above said path and between said spaced loosely rotatable rollers, and a sensor roller positioned below said path and adjacent to said dislocation roller.

81. A mechanism in accordance with claim 74, wherein each said pin is vertically moveable in order to selectively engage holes on said paper.

82. A mechanism in accordance with claim 81, each said pin being positioned on an upper surface of a vertically slidable member, said printer including at least one belt assembly for feeding said paper through said printer, wherein said belt assembly and said slidable member include complementary engaging surfaces.

83. A mechanism in accordance with claim 82, wherein there are two pins, said printer further comprising an actuation shaft engaging the slidable members attached to said pins in order to move said pins in unison.

84. A mechanism in accordance with claim 83, wherein said actuation shaft has opposed first and second ends, each of said ends being connected to a pivotable lever.

85. A mechanism in accordance with claim 81, wherein each pin is moveable into a lower position in which it does not engage holes in said paper, and into an upper position in which it engages said holes to prevent said paper from moving during said predetermined non-printing periods.

86. A mechanism in accordance with claim 27, in combination with said printer, said printer including means for feeding said paper through said printer, and means for controlling movement of said paper during said printing periods and during certain non-printing periods.

87. A mechanism in accordance with claim 86, wherein said printer is an electrophotographic printer including an image transfer unit and an image fixing unit which are spaced from each other.

88. A printer comprising an imaging fixing unit, and image transfer unit, means for feeding continuous form paper through said printer, means for controlling feeding of said paper during non-printing periods and during printing periods, and means for preventing movement of said paper during at least some of said non-printing periods, said preventing means comprising means for applying a load to said paper for preventing movement of said continuous form paper, said preventing means prevents movement of the continuous form paper when a fixing roll is separated from the continuous form paper.

89. A printer in accordance with claim 88, wherein said movement controlling means comprises a one-way clutch which is selectively engaged with a shaft which forms part of said feeding means.

90. A printer in accordance with claim 88, wherein said movement controlling means comprises a movable lever which is adapted to engage said feeding means in order to prevent movement of said paper.

91. A printer in accordance with claim 88, wherein said movement prevention means comprises a pair of rollers which are part of said image fixing unit.

92. A printer in accordance with claim 88, wherein said movement prevention means comprises at least one roller positioned between said paper feeding means and said image fixing unit.

93. A printer in accordance with claim 88, wherein said movement preventing means comprises at least one locking pin which is adapted to move between a position in which each said pin engages holes on said paper to prevent if from moving, and a position in which each said pin does not engage said holes.

* * * * *

UNITED STATES PATENT AND TRADEMARK OFFICE

CERTIFICATE OF CORRECTION

PATENT NO. : 5,305,068

DATED : April 19, 1994

INVENTOR(S) : T. SATO et al.

It is certified that error appears in the above-indentified patent and that said Letters Patent is hereby corrected as shown below:

On the title page of the patent, in the designated section "[57]", line 14 of the abstract, change "charge" to ---charger---.

At column 27, line 29 (claim 56, line 2) of the printed patent, change " step" to ---stop---.

At column 28, line 11 (claim 66, line 2) of the printed patent, change "rollers" to ---roller---.

At column 28, line 28 (claim 70, line 1) of the printed patent, change "clam" to ---claim---.

Signed and Sealed this

Twenty-fifth Day of October, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,305,068

DATED : April 19, 1994

INVENTOR(S) : T. Sato, et al

It is certified that error appears in the above-indentified patent and that said Letters Patent is hereby corrected as shown below:

On the title page, item [30], Foreign Application Priority Data, "4-141255" should read --4-121455--.

Signed and Sealed this

Twenty-first Day of February, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,305,068
DATED : April 19, 1994
INVENTOR(S) : T. SATO et al.

It is certified that error appears in the above-indentified patent and that said Letters Patent is hereby corrected as shown below:

On the title page, item: [73], Assignee, line 1, insert ---Kogyo--- after "Kogaku".

Signed and Sealed this

Twenty-first Day of May, 1996

Bruce Lehman

*Attest:*

BRUCE LEHMAN

*Attesting Officer*

*Commissioner of Patents and Trademarks*